US007863234B2

(12) United States Patent
Maki et al.

(10) Patent No.: US 7,863,234 B2
(45) Date of Patent: Jan. 4, 2011

(54) LIQUID DETERGENT COMPOSITION

(75) Inventors: Masataka Maki, Wakayama (JP); Yuichiro Tase, Wakayama (JP); Hitoshi Ishizuka, Wakayama (JP); Nobuyoshi Yamaguchi, Wakayama (JP)

(73) Assignee: Kao Corporation, Tokyo (JP)

( * ) Notice: Subject to any disclaimer, the term of this patent is extended or adjusted under 35 U.S.C. 154(b) by 177 days.

(21) Appl. No.: 12/084,264

(22) PCT Filed: Dec. 26, 2006

(86) PCT No.: PCT/JP2006/326350

§ 371 (c)(1),
(2), (4) Date: Apr. 29, 2008

(87) PCT Pub. No.: WO2007/077953

PCT Pub. Date: Jul. 12, 2007

(65) Prior Publication Data

US 2009/0249557 A1 Oct. 8, 2009

(30) Foreign Application Priority Data

Dec. 28, 2005 (JP) ..... 2005-379146
May 18, 2006 (JP) ..... 2006-139116

(51) Int. Cl.

| | |
|---|---|
| ***C11D 1/72*** | (2006.01) |
| ***C11D 1/722*** | (2006.01) |
| ***C11D 3/04*** | (2006.01) |
| ***C11D 3/20*** | (2006.01) |
| ***C11D 3/39*** | (2006.01) |

(52) U.S. Cl. ..... 510/303; 510/309; 510/311; 510/336; 510/337; 510/356; 510/372; 510/376; 510/465; 510/470; 510/499; 510/505; 510/506

(58) Field of Classification Search ..... 510/303, 510/309, 311, 336, 337, 356, 372, 376, 465, 510/470, 499, 500, 505, 506; 8/111, 137
See application file for complete search history.

(56) References Cited

U.S. PATENT DOCUMENTS

| | | | |
|---|---|---|---|
| 4,909,962 | A | 3/1990 | Clark |
| 5,827,447 | A | 10/1998 | Tamura et al. |
| 5,880,079 | A | 3/1999 | Polotti et al. |
| 5,900,187 | A | 5/1999 | Scialla et al. |
| 5,977,044 | A | 11/1999 | Peterson et al. |
| 6,020,300 | A | 2/2000 | Tcheou et al. |
| 6,699,828 | B1 | 3/2004 | de Buzzaccarini et al. |

FOREIGN PATENT DOCUMENTS

| | | | | |
|---|---|---|---|---|
| EP | 1 038 947 | A2 | | 9/2000 |
| JP | 63-68700 | A | | 3/1988 |
| JP | 3-17194 | A | | 1/1991 |
| JP | 5-271691 | A | | 10/1993 |
| JP | 6-207196 | A | | 7/1994 |
| JP | 9-157693 | A | | 6/1997 |
| JP | 2669590 | B2 | | 7/1997 |
| JP | 2688844 | B2 | | 8/1997 |
| JP | 10-072595 | | * | 3/1998 |
| JP | 10-72595 | A | | 3/1998 |
| JP | 10-072597 | | * | 3/1998 |
| JP | 10-504584 | A | | 5/1998 |
| JP | 11-50099 | A | | 2/1999 |
| JP | 11-501354 | A | | 2/1999 |
| JP | 11-502883 | A | | 3/1999 |
| JP | 11-181491 | A | | 7/1999 |
| JP | 11-181492 | A | | 7/1999 |
| JP | 2002-338997 | A | | 11/2002 |
| JP | 2003-268398 | A | | 9/2003 |
| JP | 2005-273062 | A | | 10/2005 |
| JP | 2006-169515 | A | | 6/2006 |
| JP | 2006-169516 | A | | 6/2006 |
| JP | 2006-169517 | A | | 6/2006 |
| WO | WO-2006/054526 | A1 | | 5/2006 |

OTHER PUBLICATIONS

Machine Translation of JP10-072595.*
Machine Translation of JP10-072597.*
Machine Translation of JP2006169515.*
Supplementary European Search Report issued on Nov. 20, 2009 in corresponding EP Application No. 06843722.7.

* cited by examiner

*Primary Examiner*—Gregory R Del Cotto
(74) *Attorney, Agent, or Firm*—Birch, Stewart, Kolasch & Birch, LLP

(57) ABSTRACT

The present invention relates to a liquid detergent composition containing (a) hydrogen peroxide or a compound forming hydrogen peroxide in water, 0.1 to 10 mass % of (b) a bleaching activator, 45 to 80 mass % of (c) a nonionic surfactant, (d) water, (e) at least one or more compounds selected from boric acid, borax and borate, and (f) a polyol compound, said liquid detergent composition having a pH value of 4 to 7 at 20° C.

9 Claims, 2 Drawing Sheets electric conductivity (mS/m)
600
500
400
300
200
100
0
Aqueous continuous phase
surfactant-containing continuous phase
0
20
40
60
80
100
Amount of (surfactant + solvent) (%)
Example 2-1
Comparative Example 2-1

LIQUID DETERGENT COMPOSITION

FIELD OF THE INVENTION

The present invention relates to a liquid detergent composition, a method of washing clothing with the same, and a process for producing the liquid detergent composition.

BACKGROUND OF THE INVENTION

A hydrogen peroxide-containing liquid oxygen-type bleaching agent is a product highly accepted by the consumer because it is usable for colored clothes having a design and applicable directly to dirt. However, the liquid oxygen-type bleaching agent is inferior in oxidizing power to a chlorine-type bleaching agent and thus has a problem of weak bleaching power. For the purpose of increasing the bleaching power of the oxygen-type bleaching agent, an oxygen-type bleaching agent further containing a bleaching activator of an organic peracid precursor type, which has a higher oxidizing power than hydrogen peroxide, has been utilized in the field of detergents for clothing in recent years. This bleaching activator of an organic peracid precursor type reacts with hydrogen peroxide in a weakly alkaline washing bath, to form an organic peracid. By the oxidizing power of this formed organic peracid, a bleaching effect is obtained. Generally, the bleaching activator has an active ester group etc., and thus attention should be paid to the storage stability thereof in the form of a product. A powdery oxygen-type bleaching agent is made stable by separating a granulated product of a bleaching activator as other particles from sodium percarbonate serving as a source of hydrogen peroxide. In a liquid oxygen-type bleaching agent, on the other hand, hydrogen peroxide and the bleaching activator cannot be separated from each other in the liquid, and thus the hydrolysis of the bleaching activator by hydrogen peroxide is hardly suppressed, and stable blending with the bleaching activator is extremely difficult.

Hydrogen peroxide and a bleaching activator exhibit a higher bleaching effect in the neutral to alkaline range than in the acidic range, but hydrogen peroxide and a bleaching activator are poor in storage stability in the neutral to alkaline range. Accordingly, there is need for techniques wherein a liquid oxygen-type bleaching agent containing hydrogen peroxide and a bleaching activator is stabilized at a higher pH to attain excellent bleaching performance. As a method conceivable for achieving this object, there is an embodiment wherein two preparations, that is, a low-pH composition containing a bleaching base and a high-pH composition containing an alkali, are prepared in separated forms and mixed at the time of use to form a bleaching composition, but a preparation of a one-pack liquid type is desirable from the viewpoint of simplification of a container and usability.

JP-B 2669590 discloses a liquid bleaching composition formulated stably by forming mixed micelles by using a bleaching activator and a highly interactive surfactant simultaneously.

JP-A 10-72595 discloses a liquid bleaching composition excellent in storage stability over a long time and exhibits bleaching performance even when used alone by applying a pH jumping technique using a boron compound and a polyol compound simultaneously (technique using a system wherein upon dilution, pH is increased beyond neutrality (pH 7)).

An oxygen-type liquid bleaching agent based on hydrogen peroxide became widespread because it scarcely damages dye/fibrous material and can be easily used by direct application to the stain. Autolysis of hydrogen peroxide proceeds at the weakly alkaline range to generate an oxygen gas, and the pH of the oxygen-type liquid bleaching agent marketed presently is regulated in the acidic range. However, the bleaching effect of hydrogen peroxide is higher in the neutral to alkaline range than in the acidic range, so there is a need for techniques of stabilizing hydrogen peroxide at a higher pH.

JP-A 11-181491 and JP-A 11-181492 disclose a liquid bleaching composition wherein hydrogen peroxide is stabilized in a high pH range (pH 4 to 7) by a phenol derivative.

Studies on incorporation of functional base materials such as a bleaching activator, a perfume and a dye into the product blended with hydrogen peroxide have been conducted for the purpose of improving bleaching performance and popularity, but these base materials have a structure such as an ester group, an unsaturated bond etc., and are easily denatured and inactivated by hydrogen peroxide, and thus stabilization thereof is difficult, and in the related art, there is a problem of storage stability over a long period.

The bleaching activator reacts with hydrogen peroxide in a washing bath to form an organic peracid which in turn effectively decomposes stain and dirt thereby improving the bleaching power and assisting with solving the problem of the oxygen-type bleaching agent. The bleaching activator used in recent years includes tetraacetylethylenediamine (TAED), sodium nonanoyloxybenzenesulfonate. These compounds have structures such as an unstable ester group and amide group and thus undergo hydrolysis and peroxide hydrolysis in an aqueous hydrogen peroxide solution at pH 3 or more, so there is a problem of easy inactivation.

JP-A 6-207196 discloses techniques of using suppression, in surfactant micelles, of hydrolysis of an ester linkage. JP-A 11-50099 discloses a bleaching composition having excellent storage stability and bleaching performance by using a hydrophobic bleaching activator blended with a fatty acid or a salt thereof.

In the field of detergents, softeners etc., an interest in the odor of a bleaching agent becomes higher than before in recently attracted product development of a perfume for a preferred odor and for affectivity performance. However, the perfume also has a structure such as an unsaturated bond and aldehyde group which is highly sensitive to oxidation, and is very unstable in the presence of hydrogen peroxide.

For improving the odor stability of the perfume, JP-A 11-50099 discloses a composition containing a perfume of a specific odor and a specific aromatic compound incorporated therein. JP-A 2002-338997 discloses a method of improving perfume stability under exposure to light, referring to incorporation of a phenol compound and a chelating agent.

The dye has an effect not only of improving an liking to a liquid composition by coloration thereof but also of improving convenience by coloring a liquid composition to facilitate visualization thereof in fluid measurement and visualization of the place where the liquid composition was applied to staining. The coloration of a bleaching agent has been examined from long ago, but the dye has a structure highly sensitive to oxidation, such as a conjugated structure or a chromophore, and thus prevention of the dye from fading in hydrogen peroxide has been insufficient.

JP-B 2688844 discloses a composition containing a nonionic surfactant and an acidic dye. JP-A 2003-268398 discloses a method wherein storage stability under conditions including those under light exposure is improved by incorporating a phenol-type radical trapping agent. JP-A 5-271691 discloses a liquid bleaching composition having excellent storage stability, containing a florescent brightener as one kind of dye dispersed in a bleaching agent.

SUMMARY OF THE INVENTION

[1] The present invention relates to a liquid detergent composition containing (a) hydrogen peroxide or a compound forming hydrogen peroxide in water [referred to hereinafter as component (a)], 0.1 to 10 mass % of (b) a bleaching activator [referred to hereinafter as component (b)], 45 to 80 mass % of (c) a nonionic surfactant [referred to hereinafter as component (c)], (d) water [referred to hereinafter as component (d)], (e) at least one or more compounds selected from boric acid, borax and borate [referred to hereinafter as component (e)], and (f) a polyol compound [referred to hereinafter as component (f)], the liquid detergent composition having a pH value of 4 to 7 at 20° C.

The present invention also relates to a method of washing clothes, which includes diluting the liquid detergent composition of the invention described above with water in 50- to 1500-fold excess by volume and heating the dilution at 20 to 60° C. to use it in order to achieve at least one effect preferably selected from bleaching, washing, bacteria elimination and deodorization.

Further, the present invention relates to a process for producing the liquid detergent composition of the present invention, which includes steps of preparing a mother liquor, having a pH of 3 to 7, containing the components (c), (d), (e) and (f) mixed therein and adding the components (a) and (b) simultaneously or separately to the mother liquor.

[2] The present invention also relates to a liquid bleaching detergent composition containing hydrogen peroxide, which contains a water-in-oil emulsion (W/O emulsion) having aqueous liquid droplets dispersed in a surfactant-containing continuous phase.

DETAILED DESCRIPTION OF THE INVENTION

JP-B 2669590 and JP-A 10-72595 do not refer to the influence of pH on the stability of the bleaching activator, such as a significant reduction in the stability of the bleaching activator in the weakly acidic to neutral range rather than the acidic range, and do not suggest any method of stabilizing the bleaching activator at pH 3 or more, which has been difficult in the existing art.

Accordingly, the present invention provides a liquid detergent composition, which is substantially not problematic in the stability of hydrogen peroxide and a bleaching activator even in the weakly acidic range, which can increase pH to a satisfactory region after dilution with water, and which can form an organic peracid sufficiently from a bleaching activator.

Since the present invention has the above constitution, there is brought about an excellent effect that there is substantially no problem in the stability of hydrogen peroxide and a bleaching activator even in the weakly acidic range. That is, the liquid detergent composition of the present invention is compounded with a specific content of a nonionic surfactant thereby surprisingly enabling hydrogen peroxide and the bleaching stabilizer to be stably maintained even in the weakly acidic range (pH of about 4 to about 7). Further, the pH of the liquid detergent composition of the present invention before dilution with water can be set in the weakly acidic region, and the pH of the liquid detergent composition of the present invention after dilution with water can be increased to a higher range (pH of about 8 or more), and as a result, an organic peracid can be sufficiently generated from the bleaching activator.

In the liquid detergent composition of the present invention, there is substantially no problem in the stability of hydrogen peroxide and a bleaching activator even in the weakly acidic range, and the pH of the liquid detergent composition after dilution with water can be increased to a satisfactory range, resulting in allowing the bleaching activator to sufficiently generate an organic peracid, and thus there is brought about an effect that a liquid detergent composition having excellent bleaching performance can be obtained.

The techniques of stabilizing hydrogen peroxide, as described in JP-A 11-181491 or JP-A 11-181492, are not satisfactory in storage stability over a long period, and when a bleaching activator is used, there are problems such as yellowing to cause deterioration in commercial value.

In JP-A 6-207196, the stability of a bleaching activator, a perfume and a dye (including a fluorescent brightener) is higher than in the related art, but there is a limit to the design of the composition because of a limitation from the viewpoint of the stability of the base material itself.

Accordingly, the present invention provides a liquid bleaching detergent composition having a high stability, which even in the weakly acidic range, prevents hydrogen peroxide from being decomposed during long-term storage thereby effectively suppressing gas generation. The present invention also provides a liquid bleaching detergent composition capable of realizing high stability, which does not cause inactivation or deterioration during long-term storage, even after blending with components unstable to hydrogen peroxide, such as a bleaching activator, a perfume and a dye.

The liquid bleaching detergent composition of the present invention uses formation of a W/O structure (emulsion) with a surfactant thereby effectively suppressing gas generation attributable to decomposition of hydrogen peroxide. By further utilizing this effect, the stabilization of components unstable in hydrogen peroxide, such as a bleaching activator, a perfume and a dye, can also be realized.

According to the present invention, there is provided a liquid bleaching detergent composition having high stability which even in the weakly acidic range, prevents hydrogen peroxide from being decomposed during long-term storage thereby effectively suppressing gas generation. According to the present invention, there is also provided a liquid bleaching detergent composition capable of realizing high stability without causing inactivation or deterioration in storage over a long period, even after blending with components unstable to hydrogen peroxide, such as a bleaching activator, a perfume and a dye.

In the present invention, there are two embodiments, that is, an embodiment (embodiment A) of the liquid detergent composition and an embodiment (embodiment B) of the liquid bleaching detergent composition, and the respective embodiments are described below.

Embodiment A

The liquid detergent composition of the present invention contains (a) hydrogen peroxide or a compound forming hydrogen peroxide in water [referred to hereinafter as component (a)]; 0.1 to 10 mass % of (b) a bleaching activator [referred to hereinafter as component (b)], 45 to 80 mass % of (c) a nonionic surfactant [referred to hereinafter as component (c)], (d) water [referred to hereinafter as component (d)], (e) at least one or more compounds selected from boric acid, borax and borate [referred to hereinafter as component (e)], and (f) a polyol compound [referred to hereinafter as component (f)], said liquid detergent composition having a pH value of 4 to 7 at 20° C.

[Component (a)]

The liquid detergent composition of the present invention contains, as the component (a), hydrogen peroxide or a compound for forming hydrogen peroxide in water. The compound for forming hydrogen peroxide in water includes a percarbonic acid salt, a perboric acid salt and the like. The content of component (a), in terms of hydrogen peroxide, is preferably 0.1 to 6 mass %, more preferably 0.5 to 5 mass %, even more preferably 1 to 4.5 mass %, even more preferably from 1 to 3 mass %, based on the liquid detergent composition. Within the above-specified range, excellent bleaching effects can be obtained.

[Component (b)]

The liquid detergent composition of the present invention contains a bleaching activator as the component (b).

In this specification, the bleaching activator means a compound reacting with an inorganic peroxide to form an organic peracid. The bleaching activator of the present invention includes a compound having an ester linkage represented by the following formula:

$$R—C(=O)\text{-}LG \quad (1)$$

wherein R represents an about C6 to C13 linear or branched alkyl or alkenyl group, an aryl group, or an aryl group substituted with an alkyl group, and is preferably an about C6 to C13 branched alkyl group, and LG is a leaving group which specifically includes:

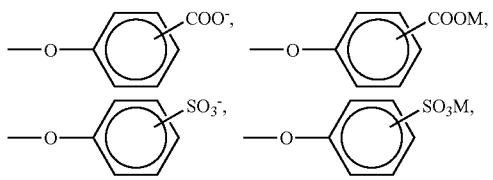

$—O—R^1—(O)_p—SO_3^-$ and $—O—R^1—(O)_p—SO_3M$ wherein $R^1$ represents an alkylene group, p is 0 or 1, and M represents a hydrogen atom, an alkali metal or an alkaline earth metal. The number of carbon atoms in the alkylene group represented by $R^1$ is preferably 1 to 5.

A bleaching activator having an alkanoyl group having a side chain at the α- or β-position relative to the carbonyl carbon, wherein the number of carbon atoms in the alkanoyl group and side chain in total is 6 to 13, can be used as preferable component (b) in the present invention. Such bleaching activator, as compared with a bleaching activator having an alkanoyl group in the form of a linear chain, can secure storage stability in the weakly acidic region and can thus confer a higher bleaching effect and higher detergent effect on the liquid detergent composition.

Specifically preferable compounds include compounds represented by the following formula (2):

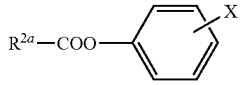

(2)

wherein $R^{2a}$—CO is an alkanoyl group having a side chain at least either at the α-position or β-position relative to the carbonyl carbon, wherein the number of carbon atoms in the alkanoyl group and side chain in total is 6 to 13, preferably 7 to 13, and $R^{2a}$— is preferably branched at the α- or β-position.

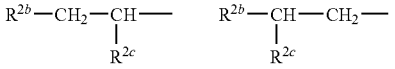

(α-position branched type) (β-position branched type)

wherein $R^{2b}$ is a C4 to C10 alkyl group, $R^{2c}$ is a group selected from a methyl group, ethyl group, propyl group and butyl group, X is a group selected from —COOM and $—SO_3M$, and M is a hydrogen atom, an alkali metal or an alkaline earth metal.

In one embodiment, the compound branched at the α-position, represented by formula (2), can be obtained by aldol condensation of C3 to C6 fatty aldehyde compounds, then oxidizing the aldehyde group, and subjecting the resulting α-branched type fatty acid (or an acid halide thereof) to an esterification reaction with p-hydroxybenzoic acid, salicylic acid, or p-hydroxybenzenesulfonic acid salt. Specific examples of the α-position branched type fatty acid can include 2-methylpentanoic acid, 2-ethylhexanoic acid, 2-propylheptanoic acid, 2-methylhexanoic acid, 2-ethylpentanoic acid, 2-ethylheptanoic acid, 3-propylhexanoic acid, 2-butyloctanoic acid etc.

In one embodiment, the compound branched at the β-position, represented by formula (2), can be obtained by hydroformylation of a 1-alkene, oxidizing the resulting aldehyde, and subjecting the resulting β-branched type fatty acid (or an acid halide thereof) to an esterification reaction with p-hydroxybenzoic acid, salicylic acid or p-hydroxybenzenesulfonic acid salt.

When a linear 1-alkene is used as a starting material, the fatty acid obtained through the hydroformylation process is a mixture of a linear fatty acid and a β-branched fatty acid having a methyl group branched at the β-position. In the present invention, it is preferable to use a fatty acid in which the mass ratio of the β-branched fatty acid/the linear fatty acid is from 20/80 to 80/20. As the branched 1-alkene, a dimer or trimer of isobutene is preferably used from the viewpoint of stability, and 3,3,5-trimethylhexanoic acid, 3,6,8,8-tetramethylnonanoic acid and the like, each of which is a β-branched type fatty acid obtained by hydroformylation of the dimer or trimer of isobutene, are preferable.

The component (b) in the present invention can be obtained by an esterification reaction of the above-mentioned α-branched type fatty acid, β-branched type fatty acid or acid anhydride or acid halide of these fatty acids with p-hydroxybenzoic acid, salicylic acid or p-hydroxybenzenesulfonic acid salt. In the case where the esterification reaction of an acid anhydride or acid halide of the fatty acid with p-hydroxybenzoic acid or salicylic acid is carried out, a poly-addition body represented having p-hydroxybenzoic acid or salicylic acid further condensed therein, represented by the following formula (3), can be formed.

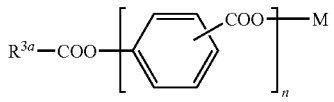

(3)

wherein $R^{3a}$ has the same meaning as that of $R^{2a}$ above, M represents a hydrogen atom, an alkali metal or an alkaline earth metal, and n is a number of 2 to 5.

The compound of formula (3) is preferably contained in the liquid detergent composition because it can achieve a very high bleaching effect by reacting, in a bleaching bath or a detergent bath, with hydrogen peroxide to form not only an organic peracid represented by $R^{3a}$—COOOH, but also a hydroxybenzoic percarboxylic acid represented by:

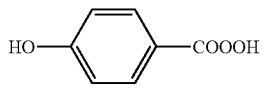

The amount of the compound represented by formula (3) is preferably 0.1 to 50 mass %, more preferably 0.1 to 30 mass %, even more preferably 0.1 to 15 mass %, based on the compound of formula (2).

The component (b) in the present invention is a compound of formula (2) wherein $R^{2a}$—CO is preferably a 2-ethylhexanoyl group, 3,5,5-trimethylhexanoyl group, 2-ethylpentanoyl group or 3,6,8,8-tetramethylnonanoyl group, even more preferably a 3,5,5-trimethylhexanoyl group. The component (b) is preferably a compound wherein X is —COOH, more preferably a compound having —COOH at the p-position.

The content of the component (b) in the liquid detergent composition of the present invention is 0.1 to 10 mass %, preferably 0.2 to 5 mass %, more preferably 0.2 to 2 mass %.

[Component (c)]

The liquid detergent composition of the present invention contains a nonionic surfactant as the component (c). The nonionic surfactant is preferably a compound of the following formula (4):

$$R^{4a}\text{—O}[(EO)_a/(PO)_b]\text{—H} \quad (4)$$

wherein $R^{4a}$ is an alkyl group or alkenyl group having 10 to 18 carbon atoms, preferably 12 to 14 carbon atoms; a is the average number of units added, which is a number of from 0 to 20 and b is the average number of units added, which is a number of from 0 to 20, provided that a and b are not simultaneously 0; preferably, the average number of units added, a, is from 6 to 15, more preferably from 7 to 12, and the average number of units added, b, is a number of from 0 to 10, more preferably from 1 to 5, even more preferably from 1 to 3.

In formula (4), EO and PO may be arranged in the form of either a random copolymer or a block copolymer.

The nonionic surfactant of the present invention is preferably a polyoxyalkylene alkyl ether type nonionic surfactant having an oxyethylene group and an oxypropylene group. The polyoxyalkylene alkyl ether type nonionic surfactant may be arranged in the form of either a random copolymer or a block copolymer, preferably a block copolymer. The block copolymer is even more preferably a compound represented by the following formula (5):

$$R^{5a}\text{—O}(EO)_a(PO)_b(EO)_c\text{—OH} \quad (5)$$

wherein $R^{5a}$ is an alkyl group or alkenyl group having 10 to 18 carbon atoms, preferably 12 to 14 carbon atoms, a is the average number of units added, which is a number of from 1 to 20, b is the average number of units added, which is a number of from 1 to 20, and c is the average number of units added, which is a number of from 1 to 20; preferably, the average number of units added, a, is from 6 to 15, more preferably from 7 to 12, the average number of units added, b, is a number of from 1 to 10, more preferably from 1 to 5, even more preferably from 1 to 3, and the average number of units added, c. is from 6 to 15, more preferably from 7 to 12.

The content of the component (c) in the liquid detergent composition is preferably 45 to 80 mass %, more preferably 50 to 75 mass %, even more preferably 55 to 70 mass %, from the viewpoint of improving the stability of the bleaching activator.

[Component (e)]

The liquid detergent composition of the present invention contains, as the component (e), at least one or more compounds selected from boric acid, borax and borate. The borate includes sodium borate, potassium borate, ammonium borate, sodium tetraborate, potassium tetraborate, ammonium tetraborate, etc.

[Component (f)]

The liquid detergent composition of the present invention contains a polyol compound as the component (f). The polyol compound in the present invention is a compound capable of forming a mono- or di-form in the liquid detergent composition (see a formula shown below), and is preferably a compound having one or more sites each having one hydroxyl group at each of adjacent carbon atoms and/or a compound having 3 or more hydroxy groups. The polyol compound is also preferably a compound having 3 or more hydroxy groups and having one or more sites having one hydroxyl group at each of the adjacent carbon atoms. Examples of the component (f) are preferably the following compounds (1) to (4), and use can be made of one or more members selected from these compounds:

(1) glycerol, diglycerol, triglycerol, an alkyl polyglyceryl ether (e.g. an alkyl diglyceryl ether having 1 to 10 carbon atoms in the alkyl group thereof and an alkyl triglyceryl ether having 1 to 10 carbon atoms in the alkyl group thereof;

(2) a sugar alcohol selected from sorbitol, mannitol, maltitose, inositol and phytic acid;

(3) a reducing saccharide selected from glucose, apiose, arabinose, galactose, lyxose, mannose, gallose, aldose, idose, talose, xylose and fructose, and derivatives thereof (alkyl (poly)glucosides etc.); and (4) a polysaccharide selected from starch, dextran, xanthan gum, guar gum, curdlan, pullulan, amylose and cellulose.

In the present invention, the above-mentioned sugar alcohol (2) is especially suitable, which may be used alone or in plurality. In particular, sorbitol is preferable from the viewpoint of stability and bleaching/detergent effect.

In one embodiment, the liquid detergent composition of the present invention can use a pH jumping system composed of a compound selected from boric acid, borax and borate as the component (e) and a polyol compound as the component (f) in a specific composition and at a specific ratio. The liquid detergent composition of the present invention can have such specific composition and ratio thereby exhibiting an excellent pH jumping effect and excellent stability of hydrogen peroxide.

In the present invention, it is preferable that the pH at 20° C. of a dilution prepared by diluting the liquid detergent composition with water in 1000-fold excess by volume is 8.5 or more and less than 10.5, and preferably 9 or more to less than 9.5, for the purpose of obtaining a bleaching/detergent effect.

Here, there is an equilibrium reaction between the component (e) and the component (f) (α,β-dihydroxy compound) as shown in the following formula (6).

(6)

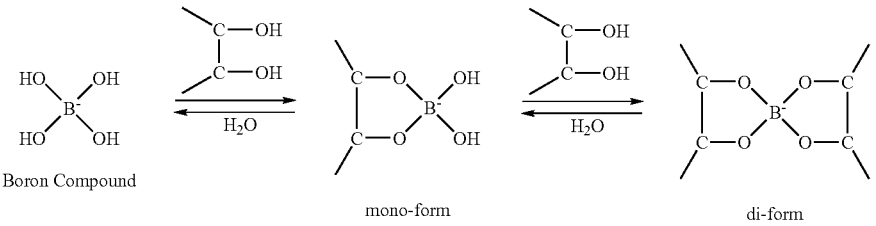

In the present invention, it is preferable that the di-form is a main component of the pH jumping system for controlling the pH of a diluted solution to 8.5 or more and less than 10.5. It is preferable that the di-form is contained in an amount of from 70 to 100% by mol based on the entire boron compounds present in the liquid detergent composition, and the mono-form is contained in an amount of preferably 0% to less than 5% by mol based on the entire boron compounds, and also that boric acid, borax and/or borate which is present alone is contained in an amount of 0% to less than 25% by mol based on the entire boron compounds. In the present invention, both the excellent pH jumping effect and the stability of hydrogen peroxide and the bleaching activator can be attained by regulating the component (f)/component (e) molar ratio (provided that borax and sodium tetraborate are regarded as 4 equivalents because these compounds contain 4 boron atoms) in the range of preferably 1.5 to 4, more preferably 1.5 to 2.7, even more preferably 2 to 2.7, even more preferably 2.2 to 2.7.

When the component (e) and the component (f) are blended in the liquid detergent composition in the present invention, these components are converted into the above-mentioned mono-form and di-form in the liquid detergent composition. Therefore, the content of the component (e) used herein means the total content of the components (e) occurring alone and as a mono-form and a di-form. The content of the component (f) means the total content of the components (f) occurring alone and as a mono-form and a di-form. The content of the component (e), in terms of boron atom, is preferably 0.05 to 1 mass %, more preferably 0.15 to 0.5 mass %, even more preferably 0.2 to 0.4 mass %, based on the liquid detergent composition, from the viewpoint of achieving an excellent pH jumping effect. The content of the component (f) is preferably 3 to 35 mass %, more preferably 5 to 30 mass %, even more preferably 10 to 20 mass %, based on the liquid detergent composition, from the viewpoint of achieving an excellent pH jumping effect.

The content of converted mono-form and di-form can be calculated by using a combination of the boron ($^{11}B$) NMR spectroscopy and ICP emission analysis methods.

[Other Components]

From the viewpoint of improving detergency and solution stability in the present invention, a solvent [referred to hereinafter as component (g)] is preferably contained. The component (g) includes (g1) a C1 to C5 monovalent alcohol, (g2) a C2 to C12 polyvalent alcohol, (g3) a compound represented by the following formula (7), and (g4) a compound represented by the following formula (8).

(7)

$$R^{7a}—O—(C_2H_4O)_j—(C_3H_6O)_k—R^{7b}$$

-continued (8)

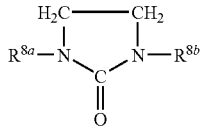

wherein $R^{7a}$ and $R^{7b}$ independently represent a hydrogen atom, a C1 to C6 alkyl group, a phenyl group or a benzyl group, provided that $R^{7a}$ and $R^{7b}$ are not simultaneously hydrogen atoms; j is a number of 0 to 10, k is a number of 0 to 10, provided that j and k are not simultaneously 0; $R^{8a}$ and $R^{8b}$ independently represent a C1 to C3 alkyl group.

Generally the C1 to C5 monovalent alcohol (g1) includes ethanol, propyl alcohol, isopropyl alcohol etc. By compounding these lower alcohols, the stability of the system at low temperatures can be further improved.

The C2 to C12 polyvalent alcohol (g2) includes isoprene glycol, 2,2,4-trimethyl-1,3-pentane diol, 1,8-octane diol, 1,9-nonane diol, ethylene glycol, propylene glycol, diethylene glycol, dipropylene glycol etc. Among these, a divalent alcohol is more preferable.

In the compound (g3) of formula (7) wherein $R^{7a}$ and $R^{7b}$ each represent an alkyl group, the number of carbon atoms in the alkyl group is more preferably 1 to 4. In formula (7), j and k which represent respectively the average numbers of ethylene oxide units and propylene oxide units added are numbers of 0 to 10 provided that j and k are not simultaneously 0, and these units may be added at random without any particular limitation to the order of adding these units. Specific examples of the compound (g3) include ethylene glycol monobutyl ether, dipropylene glycol dimethyl ether, diethylene glycol monoethyl ether, diethylene glycol monobutyl ether, propylene glycol monomethyl ether, propylene glycol monobutyl ether, propylene glycol monoethyl ether, propylene glycol dimethyl ether, polyoxyethylene (p=2 to 3) polyoxypropylene (p=2 to 3) glycol dimethyl ether (p is the average number of units added), polyoxyethylene (p=3) glycol phenyl ether (phenyl triglycol), phenyl carbitol, phenyl Cellosolve, benzyl carbitol etc. From the viewpoint of detergency, the compound (g3) is preferably propylene glycol monomethyl ether, diethylene glycol monobutyl ether (butyl diglycol), or polyoxyethylene (p=1 to 4) glycol monophenyl ether.

Preferable examples of the compound (g4) include 1,3-dimethyl-2-imidazolidinone and 1,3-diethyl-2-imidazolidinone.

Among these compounds, the solvents (g1), (g2) and (g3) are preferable for the present invention, and the solvent is more preferably a solvent selected from ethanol, isopropyl alcohol, ethylene glycol, propylene glycol, diethylene glycol, dipropylene glycol, isobutylene glycol, propylene glycol monomethyl ether, propylene glycol monoethyl ether, polyoxyethylene (average number of units added: 1 to 3), glycol monobutyl ether and polyoxyethylene (average number of units added: 1 to 4) glycol monophenyl ether, and is more preferably polyoxyethylene (average number of units added: 1 to 3) glycol monobutyl ether, polyoxyethylene (average number of units added: 4) glycol monophenyl ether, or propylene glycol.

The liquid detergent composition of the present invention can contain the component (g) in an amount of preferably 0.01 to 40 mass %, more preferably 0.1 to 30 mass %, even more preferably 1 to 20 mass %.

From the viewpoint of stability of hydrogen peroxide, the liquid detergent composition in the present invention preferably contains a sequestering agent which is preferably a compound having a phosphonic acid group or a phosphonate group (hereinafter referred to as component (h)). Specific examples of the sequestering agent having a phosphonic acid group or a phosphonate group include phosphonic acids selected from ethane-1,1-diphosphonic acid, ethane-1,1,2-triphosphonic acid, ethane-1-hydroxy-1,1-diphosphonic acid, ethanehydroxy-1,1,2-triphosphonic acid, ethane-1,2-dicarboxy-1,2-diphosphonic acid and methanehydroxyphosphonic acid or alkali metal salts or alkanolamine salts thereof, as well as phosphonocarboxylic acids selected from 2-phosphonobutane-1,2-dicarboxylic acid, 1-phosphonobutane-2,3,4-tricarboxylic acid and α-methylphosphonosuccinic acid or alkali metal salts or alkanolamine salts thereof. Preferably phosphonic acids or alkali metal salts thereof are suitable. Especially, ethane-1-hydroxy-1,1-diphosphonic acid or alkali metal salts thereof are preferable.

In the present invention, the content of the component (h) is preferably 0.05 or more and less than 0.3 mass %, more preferably from 0.1 to 0.25 mass %, and even more preferably from 0.15 to 0.2 mass %, from the viewpoint of obtaining a further preferable pH jumping effect and the viewpoint of obtaining stability of hydrogen peroxide.

In the present invention, a fatty acid having a carboxyl group or a salt thereof, a polycarboxylic acid or a salt thereof, an aminopolycarboxylic acid or a salt thereof, and/or a polymeric chelating agent (hereinafter referred to as component (h')) may be used in combination with the phosphonic acid-based sequestering agent. As used in the present invention, the fatty acid or a salt thereof is a saturated or unsaturated fatty acid having 1 to 18 carbon atoms or a salt thereof, and the polycarboxylic acid is a compound having a molecular weight of less than 1000 and having two or more carboxyl groups in the molecule, such as citric acid and succinic acid. The aminopolycarboxylic acid or a salt thereof is a compound having an acetic acid group or a succinic acid group bound to an amino group, such as ethylenediaminetetraacetic acid or a salt thereof, nitrilotriacetic acid or a salt thereof, and diethylenetriaminepentaacetic acid or a salt thereof. The polymeric chelating agent is a compound having a molecular weight of 1,000 or more and 100,000 or less, obtained by polymerizing a carboxylic acid compound having a polymerizable unsaturated bond, such as acrylic acid, methacrylic acid, maleic acid and crotonic acid. The molecular weights of these compounds are weight-average molecular weights, and can be determined by general methods such as the GPC (gel permeation chromatography) method or a light scattering method.

When the fatty acid or a salt thereof, the polycarboxylic acid or a salt thereof, and/or the aminopolycarboxylic acid or a salt thereof out of the above-mentioned carboxylic acid compounds is used in the present invention, the total amount of those compounds in the liquid detergent composition is preferably less than 0.2 mass %, more preferably less than 0.1 mass %.

In the liquid detergent composition of the present invention, a surfactant other than the nonionic surfactant as the component (c) can be contained as the component (i). Usable surfactants include anionic surfactants, cationic surfactants and/or amphoteric surfactants.

The anionic surfactant includes a linear or branched alkyl (C8 to C18) benzenesulfonate, an alkyl (C8 to C18) sulfate or an alkenyl (C8 to C18) sulfate, α-olefin (C8 to C18) sulfonate, a polyoxyalkylene alkyl ether sulfate or polyoxyalkylene alkenyl ether sulfate (number of carbon atoms in the alkyl or alkenyl group: C8 to C18) wherein the average number of alkylene oxide units added is 1 to 6, an alkane (C8 to C18) sulfonate, an α-sulfofatty salt (C8 to C18), an α-sulfofatty ester salt (preferably an ester salt of a C8 to C18 α-sulfofatty acid and a C1 to C2 alcohol), and an alkyl (C8 to C18) glyceryl ether sulfonate. These anionic surfactants can be used alone or as a mixture of two or more thereof. As the salt, a sodium salt, potassium salt, magnesium salt, calcium salt, alkanolamine salt or ammonium salt is preferable, and sodium salts, potassium salts and magnesium salts are preferable from the viewpoint of detergent effect.

The cationic surfactant is a quaternary ammonium salt in which among 4 groups bound to the nitrogen atom, one or two groups are C10 to C18 hydrocarbon groups which may be interrupted with an ester or amide group and the remaining group(s) is a C1 to C3 alkyl or hydroxyalkyl group. The quaternary ammonium salt is preferably a C1 to C3 alkyl sulfate.

From the viewpoint of detergent effect, it is preferable to contain a compound selected from compounds of the following formulae (9) and (10) as the amphoteric surfactant:

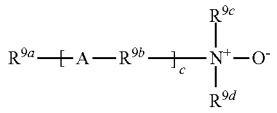

(9)

wherein $R^{9a}$ is a linear alkyl group or alkenyl group having 8 to 16 carbon atoms, preferably 10 to 16 carbon atoms, more preferably 10 to 14 carbon atoms; $R^{9c}$ and $R^{9d}$ independently represent an alkyl group or a hydroxyalkyl group, each having 1 to 3 carbon atoms, preferably a methyl group, an ethyl group or a hydroxyethyl group; $R^{9b}$ is an alkylene group having 1 to 5 carbon atoms, preferably 2 or 3 carbon atoms; A is a group selected from —COO—, —CONH—, —OCO—, —NHCO— and —O—; and c is a number of 0 or 1,

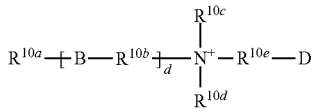

(10)

wherein $R^{10a}$ is an alkyl group or alkenyl group having 9 to 23 carbon atoms, preferably 9 to 17 carbon atoms, more preferably 9 to 15 carbon atoms; $R^{11b}$ is an alkylene group having 1 to 6 carbon atoms, preferably 2 or 3 carbon atoms; B is a group selected from —COO—, —CONH—, —OCO—, —NHCO— and —O—; d is a number of 0 or 1; $R^{10c}$ and $R^{10d}$ independently represent an alkyl group or hydroxyalkyl group having 1 to 3 carbon atoms; $R^{10e}$ is an alkylene group having 1 to 5 carbon atoms, preferably 1 to 3 carbon atoms optionally substituted with a hydroxyl group; and D is a group selected from —$COO^-$, —$SO_3^-$, and —$OSO_3^-$.

In the present invention, the content of the component (i) in the liquid detergent composition is preferably 0 to 10 mass %, more preferably 0 to 5 mass %, even more preferably 0 to 3 mass %, from the viewpoint of solution stability and bleaching activator stability during storage.

In the present invention, the components (a), (b), (c), (e) and (f) and if necessary the components (g), (h), (i) etc. can be mixed with water as the component (d), and the water used is preferably deionized water or distilled water from which a very small amount of metal dissolved in water was removed.

In the present invention, the liquid detergent composition can be prepared through a step of mixing the components (c), (d), (e) and (f) to prepare a mother liquor having a pH value of 3 to 7, preferably 3.5 to 6.5, more preferably 4 to 6 and a step of adding the components (a) and (b) simultaneously or separately to the mother liquor. For separate addition to the mother liquor, the component (a) may be first added, or the component (b) may be first added. For simultaneous addition, the component (a) and (b) may be previously mixed and then added to the mother liquor, but from the viewpoint of the stability of the bleaching activator, the components (a) and (b) are preferably separately added. For adding the component (b) to the mother liquor, a part of the component (c) may be previously mixed with the component (b) and the mixture may be added to the mother liquor. When the component (g) is used, it may be added together with other components at the time of preparation of the mother liquor.

The liquid detergent composition of the present invention can be used after dilution with water in 50- to 1500-fold excess by volume and heating the dilution at 20 to 60° C., preferably 25 to 40° C., to achieve at least one effect selected from bleaching, washing, bacteria elimination and deodorization. To achieve at least one effect selected from higher bleaching, washing, bacteria elimination and deodorization, dilution of the liquid detergent composition with water in 100- to 1000-fold excess by volume is more preferable.

The pH value of the liquid detergent composition of the invention at 20° C. is 4 to 7, preferably 4.3 to 6.5, more preferably 4.6 to 6.5, even more preferably 5 to 6. As a pH adjusting agent for adjustment to such pH range, acids, for example inorganic acids such as hydrochloric acid and sulfuric acid or organic acids such as citric acid, succinic acid, malic acid, fumaric acid, tartaric acid, malonic acid and maleic acid, or alkalis, for example sodium hydroxide, potassium hydroxide, ammonia or derivatives thereof, amine salts (monoethanolamine, diethanolamine, triethanolamine etc.), and sodium carbonate and potassium carbonate, can be used alone or as a mixture thereof. Among these compounds, an inorganic acid selected from hydrochloric acid and sulfuric acid or an inorganic base selected from sodium hydroxide and potassium hydroxide is preferably used.

In this specification, the liquid detergent composition refers to a liquid detergent composition in a transparent or semi-transparent state or an emulsified state, and when the liquid detergent composition is in a transparent or semi-transparent state, the liquid detergent composition may be composed of a one-phase system or a multiphase system containing preferably 2 or 3 phases, more preferably 2 phases.

When the liquid detergent composition of the present invention is composed of a multiphase system, the liquid detergent composition can be used after shaking or stirring to make it uniform.

The liquid detergent composition of the present invention can be used preferably in washing of fiber products such as clothing, particularly as a liquid detergent composition in a washing machine.

Embodiment B

The liquid bleaching detergent composition of the present invention is a hydrogen peroxide-containing liquid bleaching detergent composition containing a water-in-oil emulsion (W/O emulsion) having aqueous liquid droplets dispersed in a surfactant-containing continuous phase.

[Hydrogen Peroxide]

The composition of the present invention contains hydrogen peroxide (referred to hereinafter as component (A)) as a bleaching base. From the viewpoint of solution stability, hydrogen peroxide in the form of a liquid is preferred to sodium percarbonate in the form of a powder.

The content of hydrogen peroxide (A) in the present invention is preferably 0.1 to 20 mass %, more preferably 0.5 to 10 mass %, even more preferably 1 to 6 mass %, based on the liquid bleaching detergent composition, and with these ranges given, an excellent bleaching effect can be obtained.

[Surfactant]

The composition of the present invention contains a surfactant (referred to hereinafter as component (B)) to form a structure of a W/O type with the surfactant thereby efficiently preventing hydrogen peroxide from being decomposed to generate a gas. The usable surfactant can include a nonionic surfactant, an anionic surfactant, a cationic surfactant and an amphoteric surfactant.

The anionic surfactant (referred to hereinafter as component (B1)) includes a C8 to C18 alkyl or alkenyl group-containing alkyl or alkenyl benzene sulfonate, a polyoxyalkylene alkyl ether sulfate, an alkyl sulfate, an α-olefin sulfonate, an α-sulfofatty acid salt and a lower alkyl α-sulfofatty ester.

The alkyl benzene sulfonate used may be any of products having an alkyl group containing 8 to 16 carbon atoms on average, among those generally distributed in the field of detergent surfactant; for example, Neopellex F25 manufactured by Kao Corporation and Dobs 102 manufactured by Shell can be used. Industrially, the alkyl benzene sulfonate can also be obtained by sulfonating alkyl benzene distributed widely as a starting material of detergent, with an oxidizing agent such as chlorosulfonic acid, a sulfurous acid gas or the like. The average number of carbon atoms in the alkyl group is preferably 10 to 14. The polyoxyalkylene alkyl ether sulfate can be obtained by adding ethylene oxide (EO) in an amount of 0.5 to 5 moles on average to one molecule of a linear or branched primary alcohol or linear secondary alcohol having 10 to 18 carbon atoms on average and then sulfating the product by a method described in for example JP-A 9-137188. The average number of carbon atoms in the alkyl group is preferably 10 to 16. The alkyl sulfate can be obtained by sulfonating a linear or branched primary alcohol or linear secondary alcohol containing 10 to 16 carbon atoms, preferably 10 to 14 carbon atoms, with $SO_3$ or chlorosulfonic acid and then neutralizing the product. The α-olefin sulfonate can be obtained by sulfonating a C8 to C18 1-alkene with $SO_3$, then hydrating the product and neutralizing it, and the resulting product is a mixture of the compound having a hydroxyl group in a hydrocarbon group thereof and the compound having an unsaturated bond in a hydrocarbon group thereof. The lower alkyl α-sulfofatty ester preferably contains 10 to 16 carbon atoms in a fatty acid residue thereof and is preferably a methyl ester or ethyl ester in respect of detergency. The salt of the component (B1) is preferably a sodium salt, potassium salt, magnesium salt, calcium salt, alkanolamine salt or ammonium salt, and from the viewpoint of detergency, the salt is preferably a sodium salt, potassium salt or magnesium salt.

In the present invention, a polyoxyethylene alkyl sulfate having a C10 to C14 alkyl group, having 1 to 3 ethylene oxide units added on average thereto, or an alkyl benzene sulfonate having a C11 to C15 alkyl group, is more preferable from the viewpoint of detergency.

The nonionic surfactant (referred to hereinafter as component (B2)) is preferably a compound represented by the following formula (11):

$$R^{11a}—O—[(EO)_a/(PO)_b]—OH \quad (11)$$

wherein $R^{11a}$ represents an alkyl or alkenyl group containing 10 to 18 carbon atoms, preferably 12 to 14 carbon atoms, EO represents an ethyleneoxy group, PO represents a propyleneoxy group, a is a number of 0 to 20 which is the average number of units added, and b is a number of 0 to 20 which is the average number of units added, provided that a and b are not simultaneously 0; the average number of units added, a, is preferably 6 to 15, more preferably 7 to 12, and the average number of units added, b, is preferably a number of 0 to 10, more preferably 1 to 5, even more preferably 1 to 3.

In formula (11), EO and PO may be arranged in any of random and block copolymers.

An alkyl glyceryl ether having a C5 to C13 alkyl group, preferably a branched alkyl group can also be used.

The cationic surfactant (referred to hereinafter as component (B3)) is a quaternary ammonium salt (preferably a C1 to C3 alkyl sulfate) in which among 4 groups bound to the nitrogen atom, one or two groups are C10 to C18 hydrocarbon groups which may be interrupted with an ester or amide group and the remaining group(s) is a C1 to C3 alkyl or hydroxyalkyl group. However, when the bleaching activator is used, the component (B) is preferably not incorporated because its incorporation lowers stability.

From the viewpoint of detergency, it is preferable a compound selected from compounds of the following formula (9) or (10) as the amphoteric surfactant (referred to hereinafter as component (B4)):

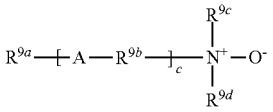

(9)

wherein $R^{9a}$ is a linear alkyl group or alkenyl group having 8 to 16 carbon atoms, preferably 10 to 16 carbon atoms, more preferably 10 to 14 carbon atoms; $R^{9c}$ and $R^{9d}$ independently represent an alkyl group or a hydroxyalkyl group, each having 1 to 3 carbon atoms, preferably a methyl group, an ethyl group or a hydroxyethyl group; $R^{9b}$ is an alkylene group having 1 to 5 carbon atoms, preferably 2 or 3 carbon atoms; A is a group selected from —COO—, —CONH—, —OCO—, —NHCO— and —O—; and c is a number of 0 or 1,

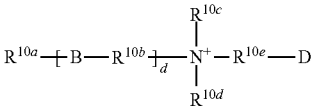

(10)

wherein $R^{10a}$ is an alkyl group or alkenyl group having 9 to 23 carbon atoms, preferably 9 to 17 carbon atoms, more preferably 9 to 15 carbon atoms; $R^{10b}$ is an alkylene group having 1 to 6 carbon atoms, preferably 2 or 3 carbon atoms; B is a group selected from —COO—, —CONH—, —OCO—, —NHCO— and —O—; d is a number of 0 or 1; $R^{10c}$ and $R^{10d}$ independently represent an alkyl group or hydroxyalkyl group having 1 to 3 carbon atoms; $R^{10e}$ is an alkylene group having 1 to 5 carbon atoms, preferably 1 to 3 carbon atoms, optionally substituted with a hydroxyl group; and D is a group selected from $—COO^-$, $—SO_3^-$, and $—OSO_3^-$.

In the present invention, a surfactant selected from the components (B1) and (B2) is preferable, and particularly for the purpose of efficiently forming a W/O emulsion for suppressing the generation of a decomposed gas from hydrogen peroxide, the component (B2) is more preferable. From the viewpoint of stability, the component (B2) is preferably contained where a bleaching activator described later is contained.

In the detergent composition of the present invention, the proportion of the component (B2) in the whole surfactant is preferably 60 mass % or more, more preferably 70 mass % or more, with respect to the effect of suppressing gas generation.

In the present invention, the content of the component (B) in the liquid bleaching detergent composition is preferably 30 to 80 mass %, more preferably 45 to 80 mass %, even more preferably 50 to 75%, even more preferably 55 to 70 mass %, from the viewpoint of solution stability during storage.

The amphoteric surfactant (B4), when used in combination with a bleaching activator, is used carefully because its use may lower stability. Specifically, the content of the component (b4) is preferably 0.5 mass % or less, more preferably 0.3 mass % or less, even more preferably 0.1 mass % or less.

In the present invention, the component (B2) is more preferable for detergency, and particularly a polyoxyalkylene alkyl ether-type nonionic surfactant having an oxyethylene group and an oxypropylene group is preferable, and a polyoxyalkylene alkyl ether-type nonionic surfactant of formula (11) wherein a is 8 to 12 and b is 0 to 3 is even more preferable. The content of the component (B2) in the composition is preferably 30 to 80 mass %, more preferably 45 to 80 mass %, even more preferably 50 to 75 mass %, even more preferably 55 to 70 mass %.

Whether the composition of the present invention has formed a W/O emulsion or not can be confirmed by specifying a continuous phase by measurement of conductivity, in addition to measurement of the particle diameter of the structure by a light scattering method.

For improving the stability of hydrogen peroxide, the liquid bleaching detergent composition of the present invention can be blended with an aqueous chelating agent and/or an antioxidant to improve the stability of hydrogen peroxide.

[Aqueous Chelating Agent]

The aqueous chelating agent of the present invention [referred to hereinafter as component (C1)] is more preferably a compound having a phosphonic acid group or a phosphonate group. Specific examples of the aqueous chelating agent having a phosphoric acid group or a phosphonate group include phosphonic acid selected from ethane-1,1-diphosphonic acid, ethane-1,1,2-triphosphonic acid, ethane-1-hydroxy-1,1-diphosphonic acid, ethanehydroxy-1,1,2-triphosphonic acid, ethane-1,2-dicarboxy-1,2-diphosphonic acid, and methanehydroxyphosphonic acid, alkali metal salts or alkanolamine salts thereof, phosphonocarboxylic acid selected from 2-phosphonobutane-1,2-dicarboxylic acid, 1-phosphonobutane-2,3,4-tricarboxylic acid and α-methylphosphonosuccinic acid, or alkali metal salts or alkanolamine salts thereof, preferably phosphonic acid or alkali metal salts thereof, more preferably ethane-1-hydroxy-1,1-diphosphonic acid or alkali metal salts thereof.

In the present invention, the content of the component (C1) is preferably in the range of 0.05 to 2 mass %, more preferably 0.1 to 1 mass %, even more preferably 0.15 to 0.2 mass %, from the viewpoint of hydrogen peroxide stability and solution stability.

In the present invention, a fatty acid having a carboxyl group or a salt thereof, a polycarboxylic acid or a salt thereof, an aminopolycarboxylic acid or a salt thereof, and/or a polymeric chelating agent (hereinafter referred to as component (C1')) may be used in combination with the phosphonic acid-based sequestering agent. As used in the present invention, the fatty acid or a salt thereof is a saturated or unsaturated fatty acid having 1 to 18 carbon atoms or a salt thereof, and the polycarboxylic acid is a compound having a molecular weight of less than 1000 and having two or more carboxyl groups in the molecule, such as citric acid and succinic acid. The aminopolycarboxylic acid or a salt thereof is a compound having an acetic acid group or a succinic acid group bound to an amino group, such as ethylenediaminetetraacetic acid or a salt thereof, nitrilotriacetic acid or a salt thereof, and diethylenetriaminepentaacetic acid or a salt thereof. The polymeric chelating agent is a compound having a molecular weight of 1,000 or more and 100,000 or less, obtained by polymerizing a carboxylic acid compound having a polymerizable unsaturated bond, such as acrylic acid, methacrylic acid, maleic acid and crotonic acid. The molecular weights of these compounds are weight-average molecular weights, and can be determined by general methods such as the GPC (gel permeation chromatography) method or a light scattering method.

When the fatty acid or a salt thereof, the polycarboxylic acid or a salt thereof, and/or the aminopolycarboxylic acid or a salt thereof out of the above-mentioned carboxylic acid compounds is used in the present invention, the total amount of those compounds in the composition is preferably less than 3 mass %, more preferably less than 2 mass %.

[Antioxidant]

The antioxidant usable in the present invention [referred to hereinafter as component (C2)] is preferably dibutyl hydroxy toluene (BHT), butylhydroxyanisole (BHA), tocopherol (vitamin E), L-ascorbic acid, erythorbic acid, catechin, phenolcarboxylic acid (salt) or phenolsulfonic acid (salt). Among them, tocopherol, catechin, phenolsulfonic acid (salt) and phenolcarboxylic acid (salt) are preferable with respect to solution stability. The content of the antioxidant in the composition of the present invention is preferably 0.1 to 3 mass %.

[Hydrogen Peroxide-unstable Compound]

Preferably, the liquid bleaching detergent composition of the present invention further contains at least one hydrogen peroxide-unstable compound (referred to hereinafter as component (D)) selected from a bleaching activator, a perfume and a dye, for the purpose of improving the commercial value of the detergent. In the description of the application, the hydrogen peroxide-unstable compound is referred to as a compound having a structure capable of cleavage with hydrogen peroxide, such as an ester group, an aldehyde group, an acetal group or an unsaturated bonding, in the molecule. The hydrogen peroxide-unstable compounds tend to be denatured and inactivated easily in hydrogen peroxide, and the stabilization of such unstable compounds can be realized by the effect of stabilization of hydrogen peroxide in the present invention.

(Bleaching Activator)

The bleaching activator in the embodiment B in this specification is the same as in the embodiment A.

(Perfume)

As the perfume used in the present invention, use is made of a perfume containing at least a perfume component selected from I) aldehyde compound, II) ester compound, III) acetal compound, IV) lactone compound, and V) unsaturated bond-containing compound. These compounds have an easily oxidized structure and are thus generally known as perfume components to be easily denatured. Specific examples of the perfume components usable in the present invention include, for example, the following compounds:

I) Aldehyde Compound

Hexyl aldehyde, heptyl aldehyde, octyl aldehyde, nonyl aldehyde, decyl aldehyde, undecyl aldehyde, dodecyl aldehyde, tridecyl aldehyde, trimethyl hexyl aldehyde, methyloctyl acetaldehyde, methylnonyl acetaldehyde, trans-2-hexenal, cis-4-heptenal, 2,6-nonadienal, cis-4-decenal, undecylene aldehyde, trans-2-dodecenal, trimethyl undecenal, 2,6,10-trimethyl-5,9-undecadienal, citral, citronellal, hydroxycitroneral, perilaldehyde, methoxydihydrocitroneral, citronellyloxy acetaldehyde, 2,4-dimethyl-3-cyclohexenylcarboxyaldehyde, isocyclocitral, centenal, myrac aldehyde, lyral, berne aldehyde, dupical, maceal, boronal, cetonal, benzaldehyde, phenyl acetaldehyde, phenyl propyl aldehyde, cinnamic aldehyde, α-amylcinnamic aldehyde, α-hexylcinnamic aldehyde, hydratropic aldehyde, anisaldehyde, p-methylphenyl acetaldehyde, cumin aldehyde, cyclamen aldehyde, 3-(p-t-butylphenyl)-propylaldehyde, p-ethyl-2,2-dimethylhydrocinnam aldehyde, 2-methyl-3-(p-methoxyphenyl)-propylaldehyde, p-t-butyl-α-methylhydrocinnamic aldehyde, salicyl aldehyde, heliotropin, helional, vanillin, ethyl vanillin, methyl vanillin etc.

II) Ester Compound

Formate, cis-3-hexenyl formate, linalyl formate, citronellyl formate, geranyl formate, benzyl formate, phenylethyl formate, ethyl acetate, butyl acetate, isoamyl acetate, methyl cyclopentylidene acetate, hexyl acetate, cis-3-hexenyl acetate, trans-2-hexenyl acetate, isononyl acetate, citronellyl acetate, lavandulyl acetate, geranyl acetate, linalyl acetate, myrcenyl acetate, terpinyl acetate, mentyl acetate, mentanyl acetate, nopyl acetate, n-bornyl acetate, isobornyl acetate, p-t-butylcyclohexyl acetate, o-t-butylcyclohexyl acetate, tricyclodecenyl acetate, 2,4-dimethyl-3-cyclohexene-1-methanyl acetal, benzyl acetate, phenylethyl acetate, stryralyl acetate, cinnamyl acetate, anicyl acetate, paracresyl acetate, heliotropyl acetate, acetyl eugenol, acetyl isoeugenol, guayl acetate, cedolyl acetate, betiberyl acetate, decahydro-α-naphthyl acetate, propionate, isoamyl propionate, citronellyl propionate, geranyl propionate, linalyl propionate, terpinel propionate, benzyl propionate, cinnamyl propionate, allyl cyclohexylpropionate, tricyclodecenyl propionate, ethyl acetate, ethyl 2-methylbutyrate, butyl butyrate, isoamyl butyrate, isoamyl butyrate, hexyl butyrate, linalyl butyrate, geranyl butyrate, citronellyl butyrate, benzyl butyrate, cis-3-hexenyl isobutyrate, citronellyl isobutyrate, geranyl isobutyrate, linalyl isobutyrate, benzyl isobutyrate, phenylethyl isobutyrate, phenoxyethyl isobutyrate, tricyclodecenyl isobutyrate, ethyl isovalerate, propyl valerate, citronellyl isobutyrate, geranyl isovalerate, benzyl isovalerate, cinnmamyl isovalerate, phenylethyl isovalerate, ethyl capronate, allyl capronate, ethyl enantoate, allyl enantoate, ethyl caprylate, citronellyl tiglate, methyl octinoate carboxylate, allyl 2-pentyloxyglycolate, cis-3-hexenylmethyl carbonate, ethyl pyruvate, ethyl acetacetate, ethyl levulinate, methyl benzoate, ethyl benzoate, isobutyl benzoate, isoamyl benzoate, geranyl benzoate, linalyl benzoate, benzyl benzoate, phenylethyl benzoate, methyl dihydroxydimethyl benzoate, methyl phenylacetate, ethyl phenylacetate, isoamyl phenylacetate, geranyl phenylacetate, benzyl phenylacetate, phenylethyl phenylacetate, p-cresyl phenylacetate, methyl cinnamate, ethyl cinnamate, benzyl cinnamate, cinnamyl cinnamate, phenylethyl cinnamate, methyl salicylate, ethyl salicylate, isobutyl salicylate, isoamyl salicylate, hexyl salicylate, cis-3-hexenyl salicylate, benzyl salicylate, phenylethyl salicylate, methyl anisate, ethyl anisate, methyl anthranylate, ethyl anthranylate, methyl methylanthranylate, methyl jasmonate, methyl dihydrojasmonate, ethyl methylphenylglycidate, ethyl phenylglycidate, glycomel, fracton, freistone, fretate, dibescone, ethyl 2-methyl-6-pentyl-4-oxa-2-cyclohexenecarbonate, etc.

III) Acetal Compound

Octyl aldehyde glycol acetal, acetaldehyde ethyl cis-3-hexenyl acetal, citral dimethyl acetal, citral diethyl acetal, acetaldehyde ethyl linalyl acetal, phenyl acetaldehyde dimethyl acetal, hydratropic aldehyde dimethyl acetal, phenyl acetaldehyde glyceryl acetal, acetaldehyde ethyl phenyl ethyl acetal, acetaldehyde phenyl ethyl propyl acetal, phenylpropyl aldehyde propylene glycol acetal, 4,4,6-trimethyl-2-benzyl-1,3-dioxane, 2-butyl-4,4,6-trimethyl-1,3-dioxane, tetrahydroindeno-m-dioxane, dimethyltetrahydroindeno-m-dioxane, caranal, etc.

IV) Lactone Compound

γ-Octalactone, γ-nonalactone, γ-decalactone, γ-undecalactone, δ-decalactone, coumarin, dihydrocoumarin, jasmolactone, jasmine lactone etc.

V) Unsaturated Bond-containing Compound

α-Pinene, β-pinene, camphene, mircen, limonene, terpinolene, ocimene, γ-terpinene, α-phellandrene, p-cimene, β-caryophyllene, β-farnesene, 1,3,5-undecatriene, diphenylmethane, trans-2-hexenol, cis-3-hexenol, 1-octene-3-ol, 9-decenol, 4-methyl-3-decen-5-ol, 10-undecenol, trans-2-cis-6-nonadienol, linallol, geraniol, nerol, citronerol, myrcenol, lavandulol, dihydromyrcenol, allocimenol, terpineol, isopregol, nopol, farnesol, nerolidol, bisabolol, vetiverol, 2,4-dimethyl-3-cyclohexene-1-metanol, 2,2-dimethyl-3-(3-methylphenyl)-propanol, ambrinol, cinnamic alcohol, eugenol, isoeugenol, propenyl guaetol, santalol, bacdanol, sandalmysor core, evanol, polysantol, nerol oxide, myroxide, rose oxide, rimetol, mentofuran, linallol oxide, tricyclodecenyl methyl ether, cedroxide, boisiris, estragol, methyl eugenol, methyl isoeugenol etc.

The perfume preferably contains a compound having an aldehyde group, an ester group, an acetal group or an unsaturated bond in an amount of 50 mass % or more, more preferably 60 to 90 mass %, based on the total perfume component.

The amount of the perfume blended in the present invention is not particularly limited, but from the viewpoint of popularity and solution stability, the amount is 0 to 10 mass %, preferably 0.01 to 5 mass %, even more preferably 0.1 to 2 mass %, based on the composition.

(Dye)

The dye used in the present invention is not particularly limited insofar as it is generally used as a dye, and the dye includes not only dyes as coloring agents in solution but also fluorescent dyes. The dyes used in the present invention include those described in "Hotei Shikiso Handbook" (Handbook of Dyes Designated by legal code) (ed. by Japan Cosmetic Industry Association), those described in "Senryo Binran" (Dye Handbook) (Organic Synthesis Handbook) and fluorescent dyes (fluorescent whiteners) compounded generally into detergents, and use can be made of at least one dye component selected from (i) oil-soluble dye, (ii) disperse dye, (iii) basic dye, (iv) acidic dye, (v) direct dye, (vi) azo compound dye, and (vii) fluorescent dye. These compounds have an easily oxidized structure and are thus generally components easily denatured and made colorless in the presence of hydrogen peroxide. Specific examples of the dye components usable in the present invention include, for example, the following compounds:

(i) Oil-soluble Dyes

C. I. Solvent Yellow 2, C. I. Solvent Yellow 6, C. I. Solvent Yellow 14, C. I. Solvent Yellow 33, C. I. Solvent Orange 1, C. I. Solvent Orange 2, C. I. Solvent Orange 14, C. I. Solvent Orange 1, C. I. Solvent Red 1, C. I. Solvent Red 3, C. I. Solvent Red 23, C. I. Solvent Red 24, C. I. Solvent Red 27, C. I. Solvent Violet 13, C. I. Solvent Violet 14, C. I. Solvent Blue 11, C. I. Solvent Blue 12, C. I. Solvent Blue 35, C. I. Solvent Blue 36 etc.

(ii) Disperse Dyes

C. I. Disperse Yellow 4, C. I. Disperse Yellow 51, C. I. Disperse Orange 11, C. I. Disperse Red 4, C. I. Disperse Red 11, C. I. Disperse Red 15, C. I. Disperse Violet 1, C. I. Disperse Violet 4, C. I. Disperse Violet 8, C. I. Disperse Violet 18, C. I. Disperse Violet 23, C. I. Disperse Violet 26, C. I. Disperse Violet 28, C. I. Disperse Violet 30, C. I. Disperse Violet 37, C. I. Disperse Blue 1, C. I. Disperse Blue 3, C. I. Disperse Blue 5, C. I. Disperse Blue 6, C. I. Disperse Blue 7, C. I. Disperse Blue 26, C. I. Disperse Blue 27, C. I. Disperse Blue 52, C. I. Disperse Blue 54, C. I. Disperse Blue 55, C. I. Disperse Blue 56, C. I. Disperse Blue 60, C. I. Disperse Blue 61, C. I. Disperse Blue 62, C. I. Disperse Blue 64, C. I. Disperse Blue 72, C. I. Disperse Blue 73, C. I. Disperse Blue 81, C. I. Disperse Blue 87, C. I. Disperse Blue 90, C. I. Disperse Blue 91, C. I. Disperse Blue 97, C. I. Disperse Blue 98, C. I. Disperse Blue 99, C. I. Disperse Blue 103, C. I. Disperse Blue 104, C. I. Disperse Blue 105, C. I. Disperse Blue 108 etc.

(iii) Basic Dyes

C. I. Basic Blue 3, C. I. Basic Blue 7, C. I. Basic Blue 21, C. I. Basic Blue 22 etc.

(iv) Acidic Dyes

C. I. Acid Yellow 1, C. I. Acid Yellow 7, C. I. Acid Orange 10, C. I. Acid Orange 19, C. I. Acid Orange 20, C. I. Acid Orange 28, C. I. Acid Orange 33, C. I. Acid Orange 41, C. I. Acid Orange 45, C. I. Acid Red 1, C. I. Acid Red 6, C. I. Acid Red 8, C. I. Acid Red 9, C. I. Acid Red 13, C. I. Acid Red 14, C. I. Acid Red 18, C. I. Acid Red 26, C. I. Acid Red 27, C. I. Acid Red 37, C. I. Acid Red 80, C. I. Acid Red 82, C. I. Acid Red 88, C. I. Acid Red 154, C. I. Acid Red 184, C. I. Acid Violet 41, C. I. Acid Violet 43, C. I. Acid Violet 51, C. I. Acid blue 23, C. I. Acid blue 23, C. I. Acid blue 25, C. I. Acid blue 27, C. I. Acid blue 40, C. I. Acid blue 41, C. I. Acid blue 43, C. I. Acid blue 45, C. I. Acid blue 78, C. I. Acid blue 80, C. I. Acid blue 92, C. I. Acid blue 112, C. I. Acid blue 126, C. I. Acid blue 129, C. I. Acid blue 138, C. I. Acid blue 161, C. I. Acid blue 182, C. I. Acid blue 183, C. I. Acid blue 203, C. I. Acid blue 204, C. I. Acid green 25, C. I. Acid green 27, C. I. Acid green 41, C. I. Acid Brown 27, C. I. Acid Black 48, C. I. Acid Black 50 etc.

(v) Direct Dyes

C. I. Direct Blue 86, C. I. Direct Blue 199 etc.

(vi) Azo Compound-based Dyes

C. I. Azoic Coupling Component 2, C. I. Azoic Coupling Component 3, C. I. Azoic Coupling Component 4, C. I. Azoic Coupling Component 7, C. I. Azoic Coupling Component 17, C. I. Azoic Coupling Component 18, C. I. Azoic Coupling Component 20, C. I. Azoic Coupling Component 23, C. I. Azoic Coupling Component 29, C. I. Azoic Coupling Component 36, C. I. Azoic Coupling Green 1 etc.

(vii) Fluorescent Dyes

A 4,4'-bis-(2-sulfostyryl)-biphenyl salt, 4,4'-bis-(4-chloro-3-sulfostyryl)-biphenyl salt, 2-(styrylphenyl)naphthothiazole derivative, 4,4'-bis-(triazol-2-yl)-stilbene derivative, bis(triazinylamino)stilbenedisulfonic acid derivative etc.

From the viewpoint of suppressing uneven application onto clothes, the fluorescent dye used in the present invention is preferably 4,4'-bis-(2-sulfostyryl)-biphenyl salt and bis(triazinylamino)stylbenedisulfonic acid derivative.

The amount of the dye used in the present invention is not particularly limited and can be suitably regulated depending on the type of dye, but from the viewpoint of popularity of liquid color and adhesion to fibers in clothes, the amount of the dye for color coloration in liquid is preferably 0.00001 to 0.01 mass %, more preferably 0.0001 to 0.005 mass %. When the amount is too low, coloration is not sufficient, while when the amount is too high, the dye may remain adhering to fibers in clothes. From the viewpoint of effect and sense after washing and prevention of uneven adhesion to clothing, the amount of the dye is preferably 0.01 to 5 mass %, more preferably 0.1 to 1 mass %.

[Organic Solvent]

The liquid bleaching detergent composition of the present invention is blended preferably with an organic solvent [referred to hereinafter as component (E)], and from the viewpoint of hydrogen peroxide stability and solution stability, the solubility parameter (δ) is preferably 7 to less than 20, more preferably 8 to less than 18. The solubility parameter (δ) is a value defined by the following equation:

$$\text{the solubility parameter } \delta=(\Delta H/V)^{1/2}$$

wherein ΔH (cal/mol) is the evaporation heat per mole of organic solvent, and V ($cm^3$·mol) is the molar volume of organic solvent.

Specific examples of the organic solvent having a solubility parameter (δ) of 7 to less than 20 include compounds represented by formula (12) below as well as ester-based organic solvents (for example, methyl acetate, ethyl acetate, methyl propionate etc.), ketone-based organic solvents (for example, acetone, diethyl ketone, methyl ethyl ketone, diisopropyl ketone, methyl isobutyl ketone, methyl isopropyl ketone etc.), ether-based organic solvents (dioxane, tetrahydrofuran, triethylene glycol dimethyl ether etc.) and polyvalent alcohol-based organic solvents (propylene glycol, glycerin etc.).

$$R^1—O—(AO)_nH \quad (12)$$

wherein $R^1$ represents a hydrogen atom, a linear or branched C1 to C6 alkyl group, a phenyl group or a benzyl group, A represents a linear or branched C2 to C4 alkylene group, and A's whose number is n may be the same or different, and n is a number of 0 to 5 indicating the average number of alkylene oxide units added.

Specific examples of the compounds represented by formula (12) include alcohols such as ethanol, propanol and butanol, glycols such as ethylene glycol, diethylene glycol and triethylene glycol, polyalkylene glycol alkyl ethers such as diethylene glycol butyl ether and triethylene glycol phenyl ether. Among these organic solvents, the alkylene oxide-chain containing compounds represented by formula (12) and the polyvalent alcohol-based organic solvents are preferable, among which ethanol, polyethylene glycol monobutyl ether (average number of EO units added: 1 to 4), polyethylene glycol monopropyl ether (average number of EO units added: 1 to 4), polyethylene glycol monophenyl ether (average number of EO units added: 1 to 4), ethylene glycol, propylene glycol etc. are preferable.

In the present invention, the content of the component (E) in the composition is preferably 0 to 40 mass %, more preferably 5 to 30 mass %, even more preferably 10 to 20 mass %, from the viewpoint of solution stability.

[Water]

The present invention is directed to a composition of a water-in-oil emulsion type having aqueous liquid droplets dispersed and/or emulsified in a surfactant-containing continuous phase by using the above components and water, and from the viewpoint of storage stability, the water used is preferably deionized water or distilled water from which metal dissolved in a very small amount was removed. The water content is 5 to 30 mass %, more preferably 10 to 25%.

The liquid bleaching detergent composition of the present invention is characterized by using formation of a structure (emulsion) of a W/O type composed of a surfactant and water. Usually, as the pH is increased, the decomposition of hydrogen peroxide is accelerated thereby generating an oxygen gas rapidly; however, it was found that by incorporating hydrogen peroxide into the composition of W/O type, its gas generation can be effectively suppressed in a pH range in the vicinity of neutrality. The mechanism for this phenomenon is not evident, but it is estimated that the stabilization of hydrogen peroxide can be attained by dispersing hydrogen peroxide in a finely dispersed aqueous phase.

It was unexpectedly found that although the organic compounds such as a bleaching activator, a perfume and a dye are easily decomposed upon contacting with hydrogen peroxide, the organic compounds when converted into a W/O composition are made highly stable in the presence of hydrogen peroxide. The stability of a hydrogen peroxide-unstable compound having an aromatic ring is significantly improved particularly in a W/O composition using an ethylene oxide-added nonionic surfactant, so it is considered that these unstable compounds are partitioned at high concentration into a surfactant (nonionic surfactant) continuous layer thereby separating them from hydrogen peroxide in an aqueous phase, to attain high stability.

[pH]

The pH value of the liquid bleaching detergent composition of the invention at 20° C. is preferably 3 to 7, more preferably 4 to 6.5, even more preferably 4.5 to 6. As a pH adjusting agent for adjustment to such pH, acids for example inorganic acids such as hydrochloric acid and sulfuric acid or organic acids such as citric acid, succinic acid, malic acid, fumaric acid, tartaric acid, malonic acid and maleic acid, and alkalis for example sodium hydroxide, potassium hydroxide, ammonia or derivatives thereof, amine salts such as monoethanolamine, diethanolamine, triethanolamine etc., and sodium carbonate and potassium carbonate are used preferably alone or as a mixture thereof, and an acid selected from hydrochloric acid and sulfuric acid and an alkali selected from sodium hydroxide and potassium hydroxide are preferably used.

pH was measured with a pH meter (F-52) manufactured by Horiba, Ltd. As standard solutions, phthalate (pH 4), neutral phosphate (pH 7) and borate (pH 9) manufactured by Sigma Aldrich Japan were used.

In the present invention, the components (A) and (B) and if necessary the components (C), (D), (E) etc. can be mixed with water to give the composition.

[Particle Diameter]

The particle diameters of aqueous liquid droplets in the liquid bleaching detergent composition of the present invention are preferably 1 to 1000 nm, preferably 10 to 100 nm, from the viewpoint of the storage stability of hydrogen peroxide.

[Viscosity]

The viscosity of the liquid bleaching detergent composition of the present invention at 20° C. is preferably in the range of 3 to 1000 mPa·s, more preferably 10 to 500 mPa·s, from the viewpoint of usability and solution stability.

The object to be washed with the liquid bleaching detergent composition of the present invention is preferably fiber products such as clothing, and the composition is applied, even more preferably to fiber products such as clothing bleached and washed in a washing machine.

EXAMPLES

Figure 1:
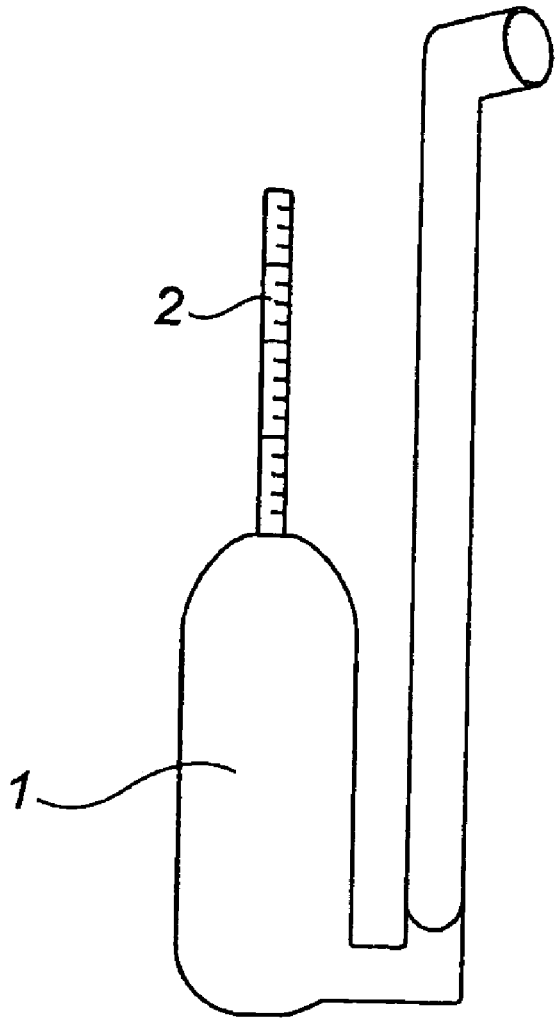
FIG. 1 is an apparatus used in measurement of the amount of gas generated in the Examples and Comparative Examples.

The present invention is described in more detail by reference to the Examples. The Examples are illustrative of the present invention and are not intended to limit the present invention.

Test Example A

The liquid detergent compositions (Example invented Products 1 to 5 and Comparative Products 1 to 4) shown in Table 1 were prepared from the following compounding ingredients and evaluated in the following manner. The results are shown in Table 1. The pH (20° C.) of the stock solution and the pH of the liquid detergent composition after dilution with water at 20° C. in 1000-fold excess by volume are also shown in Table 1.

(1) Bleaching Power after Storage

The liquid detergent composition was stored at 30° C. for 1 week and then diluted to a concentration of 0.1 vol % with 3° DH hard water, and by using the dilution, 4 grape juice-stained clothes prepared below were washed in a Tergoto meter (80 rpm×10 minutes). Thereafter, the grape juice-stained clothes were rinsed with tap water and then dried to determine the degree of bleaching by the following equation:

Degree of bleaching (%)=(reflectance after bleaching−reflectance before bleaching)/(reflectance of white cloth−reflectance before bleaching)×100

The reflectance was measured with NDR-10DP with a 460-nm filter, manufactured by Nippon Denshoku Kogyo Co., Ltd.

(Preparation of the Grape Juice-Stained Clothes)

Cotton gold clothes #2003 were dipped for half a day in grape juice (Welch's Grape 100 (expiry date: Sep. 15, 2006) in a bottle with 800 g content) manufactured by Calpis Food Industry Co., Ltd., and then the clothes were removed and air-dried. Thereafter, the clothes were cut into 6 cm×6 cm test clothes and subjected to experiment.

(2) Storage Stability (2-1) Hydrogen Peroxide Stability

The liquid detergent composition before storage and after 1 month at 40° C. was titrated with 1/10 N potassium permanganate solution to determine the effective oxygen concentration. The stability of hydrogen peroxide was determined by the following equation:

Hydrogen peroxide stability (%)=(effective oxygen concentration after storage)/(effective oxygen concentration before storage)×100

(2-2) Residual Ratio of the Bleaching Activator

The content of the bleaching activator in the liquid detergent composition before storage and after 1 week at 30° C. was measured by a high performance liquid chromatography and the residual ratio of the bleaching activator was determined by the following equation:

Residual degree of the bleaching activator (%)=(content of the bleaching activator after storage)/(content of the bleaching activator before storage)×100

<Compounded Components>

The components of the table are as follows:

a-1: hydrogen peroxide
b-1: decanoyloxy-p-benzenecarboxylic acid
b-2: sodium isononanoyloxy-p-benzenesulfonate (sodium 3,5,5-trimethylhexanoyloxy-p-benzenesulfonate)
b-3: sodium nonanoyloxy-p-benzenesulfonate
c-1: polyoxyethylene lauryl ether (average number of ethylene oxide units added: 12)
c-2: $C_{12}H_{25}O—(C_2H_4O)_7—(C_3H_6O)_2—(C_2H_4O)_5—H$
c'-1: sodium laurylbenzenesulfonate
c'-2: sodium polyoxyethylene lauryl ether sulfate (average number of ethylene oxide units added: 3)
c'-3: N-dodecyl-N,N,N-trimethyl ammonium methyl sulfate
d-1: deionized water
e-1: boric acid
e-2: sodium tetraborate
f-1: sorbitol
f-2: glucose
f-3: glycerin
f-4: polyalkyl glucoside (number of carbon atoms in the alkyl group, 12; average condensation degree, 1.5)
g-1: butyl diglycol
g-2: phenyl triglycol
g-3: propylene glycol
h-1: phosphonic acid-based sequencing agent, Diquest 2010 (manufactured by Solutia)

TABLE 1

| | | | Example Product of the Invention | | | | | Comparative example | | | |
|---|---|---|---|---|---|---|---|---|---|---|---|
| | | | 1 | 2 | 3 | 4 | 5 | 1 | 2 | 3 | 4 |
| Liquid detergent | Compounding component (mass-%) | a-1 | 2 | 2 | 3 | 2 | 4 | 2 | 2 | 3 | 2 |
| | | b-1 | 1 | | | | | 1 | | | |
| | | b-2 | | | 2 | 2 | 2 | | | 2 | 2 |
| | | b-3 | | 2 | | | | | 2 | | |
| | | c-1 | 25 | 30 | | 65 | 50 | 10 | 30 | | 65 |
| | | c-2 | 35 | 30 | 50 | | 5 | 13 | 30 | 50 | |
| | | c'-1 | | | | 1 | | | | | 1 |
| | | c'-2 | 5 | | | | | 5 | | | |
| | | c'-3 | | | | 1 | | | | | 1 |
| | | e-1*1 | 1.5 (0.26) | | | 1 (0.17) | 1.5 (0.26) | 1.5 (0.26) | | | 1 (0.17) |
| | | e-2*1 | | 2 (0.43) | 1.5 (0.32) | | | | 2 (0.43) | 1.5 (0.32) | |
| | | f-1 | | 15 | | 10 | 10 | | 15 | | |
| | | f-2 | | | 5 | | | | | 5 | |
| | | f-3 | | 5 | 7 | | | | 5 | 7 | |
| | | f-4 | 20 | | | | | 20 | | | |
| | | g-1 | 5 | | | | | 5 | | | |
| | | g-2 | | | 10 | | | | | 10 | |
| | | g-3 | | 5 | | | 10 | | 5 | | |
| | | h-1 | 0.2 | 0.2 | 0.2 | 0.2 | 0.2 | 0.2 | 0.2 | 0.2 | 0.2 |
| | | d-1 | balance | balance | balance | balance | balance | balance | balance | balance | balance |
| | | Total | 100 | 100 | 100 | 100 | 100 | 100 | 100 | 100 | 100 |
| | component (f)/component (e) molar ratio | | 1.9 | 3.4 | 3.5 | 3.4 | 2.3 | 1.9 | 3.4 | 3.5 | 0 |
| | pH of starting solution (20° C.) | | 6.0 | 5.5 | 6.0 | 6.5 | 5.0 | 6.0 | 3.5 | 7.5 | 6.5 |
| | pH (20° C.) after 1000-fold (by volume) dilution | | 9.3 | 8.8 | 9.2 | 9.4 | 8.3 | 9.4 | 7.2 | 9.4 | 6.9 |
| Stability of hydrogen peroxide (%) | | | 99 | 100 | 99 | 97 | 100 | 99 | 100 | 75 | 88 |
| Residual ratio (%) of the bleaching activator | | | 92 | 88 | 98 | 90 | 96 | 10 | 100 | 0 | 78 |
| Degree of bleaching (%) after storage | | | 82 | 80 | 85 | 80 | 85 | 50 | 42 | 48 | 38 |

*1: Numerical values in the brackets for the components e-1, e-2 means mass% in the terms of boron atom.

In the table, the pH was adjusted by 48 mass % aqueous sodium hydroxide and 20 mass % aqueous sulfuric acid.

As can be seen from the results in Table 1, the example invented products 1 to 5, as compared with the comparative products 1 to 4, have a pH value of 8 or more after dilution, show extremely excellent stability for the bleaching activator, and have a significantly high degree of bleaching after storage. It can also be seen that the example invented products have a hydrogen peroxide stability equal to, or higher than, that of the comparative products.

Test Example B

<Evaluation Method>

The following components were used to prepare the liquid detergent compositions shown in Table 2. The resulting composition was used to evaluate the amount of gas generated during storage at high temperatures, the stability of the bleaching activator, odor stability, and dye stability in the following manner. Whether the composition of the present invention has formed a W/O emulsion or not can be confirmed both by specifying a continuous phase by measurement of the conductivity of the solution and by measuring the particle diameter of its structure by a light scattering method (DLS). The results are collectively shown in Table 2.

<Compounding Ingredients> a-1: hydrogen peroxide b-1: sodium laurylbenzenesulfonate b-2: alpha-sulfofatty ester b-3: polyoxyethylene lauryl ether (average number of EO units added: 12)

b-4: $C_{12}H_{25}O—(C_2H_4O)_6—(C_3H_6O)_2—(C_2H_4O)_5—H$ b-5: polyalkyl glucoside (number of carbon atoms in the alkyl group, 12; average condensation degree, 1.5)

b-6: 2-ethyl hexyl glyceryl ether (synthesized by a method described in paragraph 0064 in JP-A 2004-43551)

c-1: 1-hydroxyethylidene-1,1-diphosphonic acid (Diquest 2010 manufactured by Solutia)

c-2: 4-methoxyphenol d-1: perfume A in Table 3 d-2: perfume B in Table 3 d-3: dye (orange 403)

d-4: fluorescent dye (FWA-8; Tinopal CBS-X manufactured by Ciba Specialty Chemicals)

e-1: propylene glycol e-2: ethanol e-3: polyethylene glycol monobutyl ether (average number of EO units added: 2)

f-1: deionized water (1) Method of Measuring the Amount of Gas Generated

A glass container 1 (content 1000 mL) shown in FIG. 1 was charged with the liquid bleaching detergent composition, then left at a thermostatic chamber at 40° C. for 1 month, and the amount of gas generated (mL) was measured until scale 2 (measurable up to 100 mL).

(2) Stability of Odor (Sensory Evaluation)

A change in the odor of the liquid bleaching detergent composition before storage and after storage for 1 month at 40° C. was evaluated by a panel of 5 persons under the following criteria and expressed as an average.

5: Change is hardly recognized.
4: A slight change is recognized.
3: Change is recognized.
2: A significant change is recognized.
1: A very significant change is recognized.

(3) Stability of Liquid Color (Visual Judgment)

A change in the color of the liquid bleaching detergent composition before storage and after storage for 1 month at 40° C. was evaluated by a panel of 5 persons under the following criteria and expressed as an average.

5: Change is hardly recognized.
4: A slight change is recognized.
3: change is recognized.
2: A significant change is recognized.
1: A very significant change is recognized.

(4) Stability of Fluorescent Dye (Storage Stability)

The content of the fluorescent dye in the liquid bleaching detergent composition before storage and after storage for 1 month at 40° C. was measured by high performance liquid chromatography and the residual ratio was determined by the following equation:

Residual degree of fluorescent dye (%)=(content of the fluorescent dye after storage)/(content of the fluorescent dye before storage)×100

<Method of Confirming the W/O-Type Composition>

The state of the solution is confirmed by the following method. The method of confirming the state of the solution using a surfactant and a solvent of Example 1-1 or Comparative Example 1-5 is described as follows.

Figure 2:
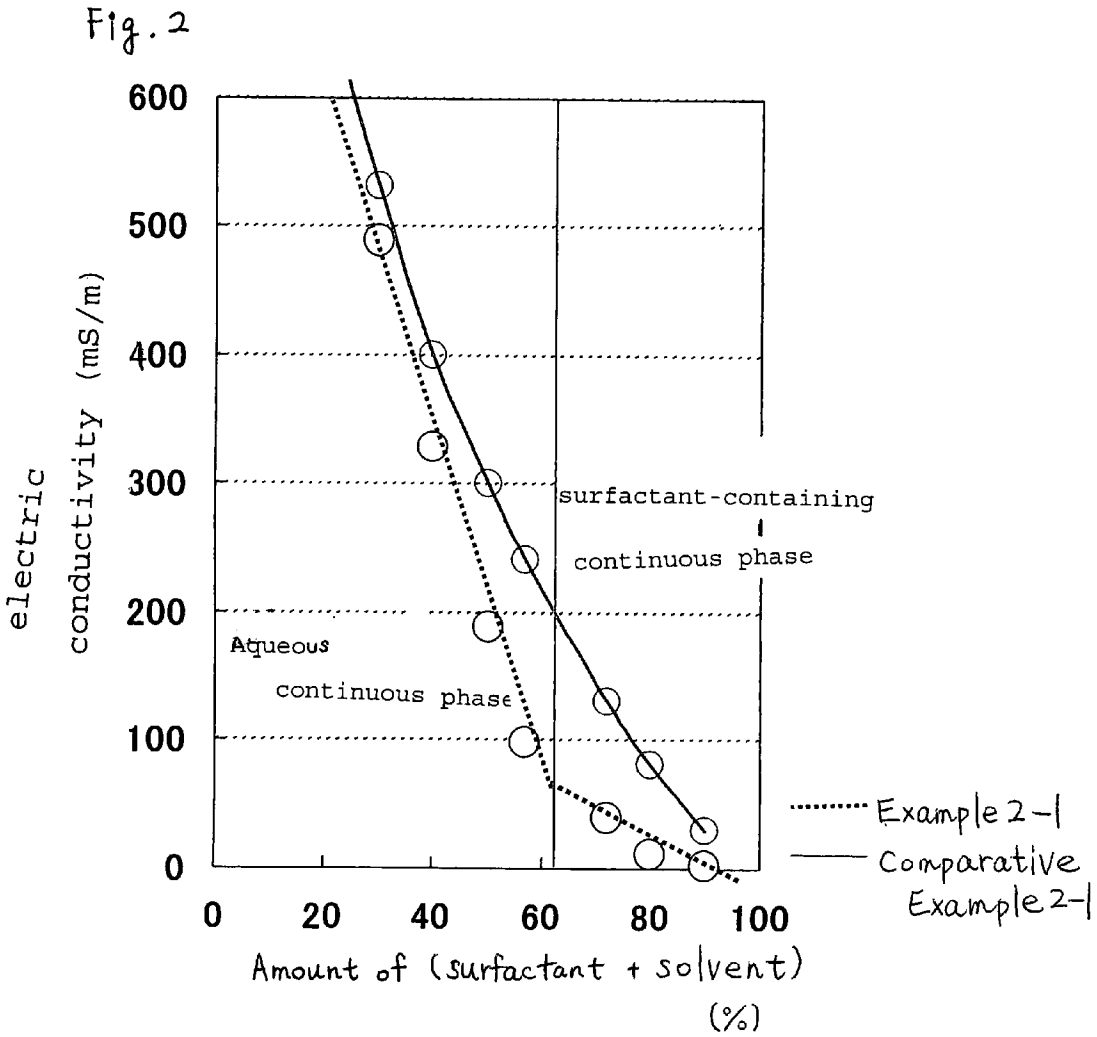
FIG. 2 shows phases confirmed by measuring electric conductivity. The reference numerals of the drawings are as follows: 1 glass container, 2 scale.

Using a surfactant and a solvent of Example 1-1, aqueous detergent compositions being different in the total amount thereof (mass %) were prepared (Example 2-1). Using a surfactant and a solvent of comparative Example 1-5, as the same as the above, aqueous detergent compositions being different in the total amount thereof were prepared (Comparative Example 2-1) (Table 4). To each solution having a changed concentration was added 0.1 M aqueous KCl solution and the electric conductivity was measured (Table 4 and FIG. 2). It is noted that, as the surfactant (nonionic surfactant) is compounded at increased concentrations, as Example 2-1, formation of the structure by the activator occurs and a discontinues inflection point, considered attributable to the transition of the continuous phase from an aqueous phase (O/W) to a surfactant phase (W/O) appears. On the other hand, when ethanol is compounded even at a high concentration, as Comparative Example 2-1, no inflection point appears and formation and change of the structure cannot be confirmed.

The particle diameter of the structure formed by the activator was estimated by dynamic light scattering (DLS). Having measured the particle diameter in the model composition in Example 1-1 (component (b-3)/component (b-4)=35/35 and 37/37), Is (scattered light intensity)/Io (incident light intensity) ratios were 0.18 and 0.12, respectively. Formation of inverted micelles of several nm to several tens nm was inferred.

(Measurement Instrument of Electric Conductivity)

The main body pH/COND METER (type: D-54) and COND electrodes (type: 3551-10D) manufactured by Horiba Seisakusho Ltd.

(Measurement Instrument of Light Scattering)

Dynamic light scattering photometer DLS-7000H manufactured by Otsuka Electronics Co., Ltd.

(Measurement Conditions of Light Scattering)

Incident light: argon laser (wavelength (λ)=488 nm), scattering angle (θ): 90°, temperature: 30° C., average value in 5 measurements.

TABLE 2

| | | | | Example Product of the Invention | | | | | | | |
|---|---|---|---|---|---|---|---|---|---|---|---|
| | | | | 1-1 | 1-2 | 1-3 | 1-4 | 1-5 | 1-6 | 1-7 | 1-8 |
| Liquid detergent composition | Compounding component (mass %) | a-1 | Hydrogen peroxide | 4 | 4 | 4 | 4 | 4 | 4 | 4 | 4 |
| | | b-1 | Surfactant | | | | | 5 | | | |
| | | b-2 | | | 5 | | | | | | |
| | | b-3 | | 35 | 15 | 30 | 25 | 40 | 45 | 37 | |
| | | b-4 | | 35 | 50 | 35 | 40 | 20 | 25 | 30 | |
| | | b-5 | | | | 5 | | 10 | | | 15 |
| | | b-6 | | | | | | | | | 25 |
| | | c-1 | Aqueous chelating agent | | 1 | 0.2 | 0.3 | | 0.2 | 0.2 | 0.2 |
| | | c-2 | or antioxidant | | 0.2 | | | | | | |
| | | d-1 | Hydrogen peroxide- | 0.5 | | | | | | | |
| | | d-2 | instable base material | | 0.5 | | 0.4 | | | | |
| | | d-3 | | 0.001 | | | | | 0.001 | | |
| | | d-4 | | | | 0.3 | | | | | |
| | | e-1 | Organic solvent | 5 | | | | | 5 | 5 | |
| | | e-2 | | | | 5 | | 5 | | | 2 |
| | | e-3 | | | | | 5 | | | 2 | |
| | | f-1 | Ion-exchange water | balance | balance | balance | balance | balance | balance | balance | balance |
| | | | Total | 100 | 100 | 100 | 100 | 100 | 100 | 100 | 100 |
| | | | Stock solution pH | 5.0 | 6.0 | 5.0 | 5.5 | 4.0 | 8.0 | 9.0 | 5.0 |
| | | | Solution form | W/O | W/O | W/O | W/O | W/O | W/O | W/O | W/O |
| | | | Amount of gas generated(ml) | 7 | 2 | 5 | 10 | 0 | 16 | 19 | 18 |
| | | | Odor stability | 4.2 | 4.4 | — | 4.0 | — | — | — | — |
| | | | Dye stability | 4.6 | — | — | — | — | 4.4 | — | — |
| | | | Residual degree of fluorescent dye(%) | — | — | 90 | — | — | — | — | — |

TABLE 2-continued

| | | | | Comparative example (Comparative product) | | | | |
|---|---|---|---|---|---|---|---|---|
| | | | | 1-1 | 1-2 | 1-3 | 1-4 | 1-5 |
| Liquid detergent composition | Compounding component (mass %) | a-1 | Hydrogen peroxide | 4 | 4 | 4 | 4 | 4 |
| | | b-1 | Surfactant | | | | | |
| | | b-2 | | | | | | |
| | | b-3 | | 5 | | 10 | | 5 |
| | | b-4 | | 5 | 2 | 15 | | |
| | | b-5 | | | | 5 | 45 | |
| | | b-6 | | | | | | |
| | | c-1 | Aqueous chelating agent | | 1 | 0.2 | 0.3 | 0.3 |
| | | c-2 | or antioxidant | | 0.2 | | | |
| | | d-1 | Hydrogen peroxide-instable base material | 0.5 | | | | |
| | | d-2 | | | 0.5 | | 0.4 | 0.4 |
| | | d-3 | | 0.001 | | | | |
| | | d-4 | | | | 0.3 | | |
| | | e-1 | Organic solvent | 5 | | | 5 | |
| | | e-2 | | | | 5 | 20 | 60 |
| | | e-3 | | | | | | |
| | | f-1 | Ion-exchange water | balance | balance | balance | balance | balance |
| | | | Total | 100 | 100 | 100 | 100 | 100 |
| | | | Stock solution pH | 5.0 | 6.0 | 5.0 | 5.5 | 5.5 |
| | | | Solution form | O/W | O/W | O/W | O/W | O/W |
| | | | Amount of gas generated(ml) | 40 | 48 | 37 | 34 | 55 |
| | | | Odor stability | 2.6 | 2.8 | — | 2.2 | 2.0 |
| | | | Dye stability | 3.2 | — | — | — | — |
| | | | Residual degree of fluorescent dye(%) | — | — | 41 | — | — |

TABLE 3a

| | | Perfume A | Perfume B |
|---|---|---|---|
| Aldehyde compound | Octyl aldehyde | 0.003 | 0.002 |
| | Nonyl aldehyde | 0.04 | 0.05 |
| | Decyl aldehyde | 0.03 | 0.05 |
| | Undecyl aldehyde | 0.1 | 0.05 |
| | Dodecyl alcohol | 0.1 | 0.001 |
| | Trans-2-hexanal | 0.3 | 0.05 |
| | Citral | 0.02 | |
| | Citronellal | | 0.005 |
| | Hydroxycitroneral | 1.5 | 0.002 |
| | Perilaldehyde | 0.002 | |
| | Myrac aldehyde | 0.1 | 0.05 |
| | Lyral | 4 | 1 |
| | Benzaldehyde | 0.005 | 0.01 |
| | Phenyl acetoaldehyde | 0.02 | 0.1 |
| | Cinnamic aldehyde | | 0.05 |
| | α-amylcinnamic aldehyde | 0.2 | 0.1 |
| | α-hexylcinnnamic aldehyde | 3 | 1 |
| | Anisaldehyde | 2 | |
| | Cyclamen aldehyde | 2 | 0.5 |
| | Heliotropin | 1 | 0.2 |
| | Helional | 0.1 | |
| | Vanillin | 0.5 | 0.2 |
| | Ethyl vanillin | 0.04 | |
| Ester compound | Linalyl formate | | 0.5 |
| | Citronellyl formate | 1 | |
| | Hexyl acetate | | 0.02 |
| | Cis-3-hexenyl acetate | 0.1 | 0.02 |
| | Ethyl acetate | | 0.05 |
| | Citronellyl acetate | 1 | 0.01 |
| | Rabandyryl acetate | 0.1 | |
| | Geranyl acetate | 0.5 | 0.05 |
| | Linalyl acetate | 2 | 0.05 |
| | Terpinyl acetate | 0.1 | 0.3 |
| | Isobornyl acetate | 0.1 | 0.05 |
| | Tricyclodecenyl acetate | 2 | 0.1 |
| | Benzyl acetate | 3 | 0.5 |
| | Phenylethyl acetate | 0.6 | |
| | Styralyl acetate | 0.6 | 0.2 |
| | Guaiac acetate | 0.6 | |
| | Cedolyl acetate | 1 | 0.01 |

TABLE 3a-continued

| | | Perfume A | Perfume B |
|---|---|---|---|
| | Citronellyl propionate | 0.6 | 0.2 |
| | Benzyl propionate | 0.3 | 0.04 |
| | Ethyl cinnamate | 0.2 | 0.02 |
| | Methyl salicylate | 0.3 | |
| | Benzyl salicylate | 10 | 5 |

TABLE 3b

| | | Perfume A | Perfume B |
|---|---|---|---|
| Acetal compound | Citral dimethyl acetal | 0.1 | 0.05 |
| | Citral diethyl acetal | 0.01 | 0.1 |
| | Acetaldehyde dimethyl acetal | | 0.01 |
| | Caranal | 0.2 | 0.01 |
| Lactone compound | γ-nonalactone | 0.2 | |
| | γ-decalactone | 0.1 | 0.01 |
| | γ-undecalactone | 1 | 0.04 |
| | δ-decalactone | | 0.1 |
| | Coumarin | 3 | 0.5 |
| | Jasmolactone | 0.3 | |
| | Jasmine lactone | 0.02 | |
| Unsaturated bond-containing compound (excluding an aromatic ring) | α-pinene | | 0.05 |
| | β-pinene | | 0.04 |
| | Limonene | 15 | 25 |
| | Terpinolene | | 0.05 |
| | Linallol | 5 | 4 |
| | Geraniol | 5 | 0.2 |
| | Nerol | | 0.15 |
| | Citronerol | 1 | 0.5 |
| | Dihydromyrcenol | 0.1 | 0.5 |
| | Terpineol | 5 | 0.2 |
| | Cinnamic alcohol | 0.2 | |
| | Santalol | | 0.1 |
| | Bacdanol | 0.5 | |
| | Evanol | 0.5 | 0.1 |
| | Polysantol | 1 | 0.05 |
| | Rose oxide | 2 | |

TABLE 3b-continued

| | | Perfume A | Perfume B |
|---|---|---|---|
| | Mentofuran | | 0.03 |
| | Linallol oxide | | 0.02 |
| Others (compound other than the above components) | Phenyl ethyl alcohol | 10 | 15 |
| | Tetrahydrolinallol | 0.5 | 5 |
| | Hyroxy citronerol | 0.4 | 5 |
| | Benzyl alcohol | 0.2 | 2 |
| | Dimethylbenzyl carbinol | 0.5 | 5 |
| | Dimethylphenylethyl carbinol | 1 | 1 |
| | Phenylethyl alcohol | 2 | 5 |
| | Acetic acid | 0.1 | 0.1 |
| | Hexanoic acid | 0.01 | 0.05 |
| | Benzoic acid | 0.5 | 0.5 |
| | 6-acetylhexatetralin | 0.2 | 8 |
| | Hexamethyl hexahydrocyclopenta-benzopyran | 0.2 | 6 |
| | Cedrol | 5 | 5 |
| | Total (%) | 100 | 100 |

TABLE 4

| | | | Example 2-1 | | | | | | |
|---|---|---|---|---|---|---|---|---|---|
| Compounding component (mass %) | a-1 | Total of (surfactant + solvent) | 30% | 40% | 50% | 57% | 72% | 80% | 90% |
| | b-1 | Surfactant | | | | | | | |
| | b-2 | | | | | | | | |
| | b-3 | | 14 | 17 | 23.3 | 26.6 | 33.6 | 34 | 42 |
| | b-4 | | 14 | 17 | 23.3 | 26.6 | 33.6 | 34 | 42 |
| | b-5 | | | | | | | | |
| | b-6 | | | | | | | | |
| | e-1 | Organic solvent | 2 | 2.5 | 3.3 | 3.8 | 4.8 | 5 | 6 |
| | e-2 | | | | | | | | |
| | e-3 | | | | | | | | |
| | f-1 | Ion-exchange water | Balance | Balance | Balance | Balance | Balance | Balance | Balance |
| | | Total | 100 | 100 | 100 | 100 | 100 | 100 | 100 |
| | | Electric conductivity (mS/m) | 488 | 328 | 188 | 98 | 40 | 12 | 2 |

| | | | Comparative example 2-1 | | | | | | |
|---|---|---|---|---|---|---|---|---|---|
| Compounding component (mass %) | a-1 | Total of (surfactant + solvent) | 30% | 40% | 50% | 57% | 72% | 80% | 90% |
| | b-1 | Surfactant | | | | | | | |
| | b-2 | | | | | | | | |
| | b-3 | | 2.3 | 3 | 3.8 | 4.4 | 5.5 | 6 | 3.9 |
| | b-4 | | | | | | | | |
| | b-5 | | | | | | | | |
| | b-6 | | | | | | | | |
| | e-1 | Organic solvent | | | | | | | |
| | e-2 | | 27.7 | 37 | 46.2 | 52.6 | 66.5 | 74 | 83.1 |
| | e-3 | | | | | | | | |
| | f-1 | Ion-exchange water | Balance | Balance | Balance | Balance | Balance | Balance | Balance |
| | | Total | 100 | 100 | 100 | 100 | 100 | 100 | 100 |
| | | Electric conductivity (mS/m) | 530 | 400 | 300 | 240 | 130 | 80 | 30 |

The invention claimed is:

1. A liquid detergent composition comprising:

(a) hydrogen peroxide or a compound forming hydrogen peroxide in water, (b) 0.1 to 10 mass % of a bleaching activator of a compound having an ester linkage represented by the following formula (I):

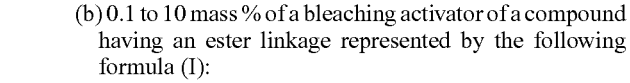

R—C(=O)-LG (1)

wherein R represents an about C6 to C13 linear or branched alkyl or alkenyl group, an aryl group, or an aryl group substituted with an alkyl group, and LG is a leaving group selected from one of the following:

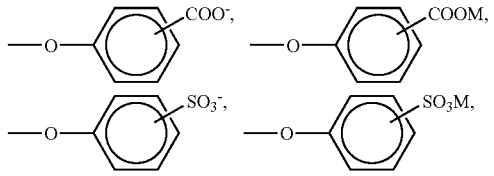

wherein M represents a hydrogen atom, an alkali metal or an alkaline earth metal, (c) 45 to 80 mass % of a nonionic surfactant, (d) water, (e) at least one or more compounds selected from the group consisting of boric acid, borax and borate, and (f) a polyol compound, wherein the liquid detergent composition having a pH value of 4 to 7 at 20° C., a molar ratio of component (f)/component (e) is from 1.5 to 4, and the liquid detergent composition has a pH value of 8.5 or more and less than 10.5 at 20° C. after dilution with water in 1000-fold excess by volume.

2. The liquid detergent composition according to claim 1, wherein the (c) nonionic surfactant comprises an oxyethylene group- and oxypropylene group-containing nonionic surfactant of the following formula (4):

$$R^{4a}—O[(EO)_a/(PO)_b]—H \quad (4)$$

wherein $R^{4a}$ is an alkyl group or alkenyl group having 10 to 18 carbon atoms, a is the average number of units added and is a number of from 0 to 20, b is the average number of units added and is a number of from 0 to 20, provided that a and b are not simultaneously 0, and EO and PO form a random copolymer or a block copolymer.

3. The liquid detergent composition according to claim 1, which further comprises (g) 0.01 to 40 mass % of solvent.

4. A method of washing clothes, which comprises the steps of diluting the liquid detergent composition of claim 1 with water in 50- to 1500-fold excess by volume and heating the dilution at 20 to 60° C. to use it in order to achieve at least one or more effects selected from bleaching, washing, bacteria elimination and deodorization.

5. A process for producing the liquid detergent composition according to claim 1, which comprises the steps of preparing a mother liquor, the mother liquor having a pH of from 3 to 7 and comprising the components (c), (d), (e) and (f) mixed therein, and adding the components (a) and (b) simultaneously or separately to the mother liquor.

6. The process for producing a liquid detergent composition according to claim 5, wherein the component (b) previously mixed with a part of the component (c) is added to the mother liquor.

7. The liquid detergent composition according to claim 1, wherein the pH of the liquid detergent composition before dilution at 20° C. is from 4.6 to 6.5.

8. The liquid detergent composition according to claim 1, wherein the (f) polyol compound is selected from the group consisting of glycerol, diglycerol, triglycerol, an alkyl polyglyceryl ether, a sugar alcohol, a reducing saccharide and a polysaccharide.

9. The liquid detergent composition according to claim 8, wherein the (f) polyol compound is selected from the group consisting of glycerol, diglycerol, triglycerol, an alkyl polyglyceryl ether having 1 to 10 carbon atoms in the alkyl group thereof, sorbitol, mannitol, maltitose, inositol, phytic acid, starch, dextran, xanthan gum, guar gum, curdlan, pullulan, amylose, cellulose, glucose, apiose, arabinose, galactose, lyxose, mannose, gallose, aldose, idose, talose, xylose, fructose, and a derivative of glucose, apiose, arabinose, galactose, lyxose, mannose, gallose, aldose, idose, talose, xylose or fructose.

* * * * *